US010307000B2

(12) United States Patent
Ward

(10) Patent No.: US 10,307,000 B2
(45) Date of Patent: Jun. 4, 2019

(54) QUICK EXCHANGE IMAGE FRAME ASSEMBLY AND RELATED METHODS

(71) Applicant: QIK, LLC, South Jordan, UT (US)

(72) Inventor: Jay B. Ward, South Jordan, UT (US)

(73) Assignee: QIK, LLC, South Jordan, UT (US)

( * ) Notice: Subject to any disclaimer, the term of this patent is extended or adjusted under 35 U.S.C. 154(b) by 0 days.

(21) Appl. No.: 15/461,472

(22) Filed: Mar. 16, 2017

(65) Prior Publication Data

US 2017/0265659 A1 Sep. 21, 2017

Related U.S. Application Data

(60) Provisional application No. 62/309,841, filed on Mar. 17, 2016.

(51) Int. Cl.
*A47G 1/06* (2006.01)
*A47G 1/16* (2006.01)

(52) U.S. Cl.
CPC ..... *A47G 1/06* (2013.01); *A47G 1/162* (2013.01); *A47G 2001/0677* (2013.01)

(58) Field of Classification Search
CPC .... A47G 2001/0677; A47G 2001/0666; A47G 1/166
USPC ..... 40/779, 792, 791, 794, 786
See application file for complete search history.

(56) References Cited

U.S. PATENT DOCUMENTS 4,466,206 A 8/1984 Meadows
4,790,089 A * 12/1988 Astolfi ..... A47G 1/0605 40/745
5,845,425 A * 12/1998 Leake ..... A47G 1/14 40/124.06
6,070,350 A * 6/2000 Fantone ..... G09F 3/20 40/427
8,667,721 B2 * 3/2014 Heeps ..... A47F 7/142 40/767
2005/0044764 A1 * 3/2005 Decker ..... G09F 7/18 40/645
2010/0139140 A1 * 6/2010 Morgan ..... A47G 1/0605 40/779

FOREIGN PATENT DOCUMENTS

JP 09-266837 10/1997
KR 20-0433829 Y1 8/1984
(Continued)

OTHER PUBLICATIONS

International Search Report and Written Opinion as received in PCT/US2017/023071 dated Jun. 27, 2017.

*Primary Examiner* — Kristina N Junge
(74) *Attorney, Agent, or Firm* — Keller Jolley Preece

(57) ABSTRACT

Embodiments of the present disclosure include an image frame assembly including a frame portion defining a viewing window and a backing panel attached to a back of the frame portion. The backing panel includes a hinge portion that rotatably couples the backing panel to the frame portion to allow the frame portion to rotate relative to the backing panel about an axis extending parallel to and proximate to an upper edge of the backing panel, a body portion extending from the hinge portion and configured to cover at least portion of a viewing window of the frame portion, and a plurality of biased members extending from the planar portion and toward the frame portion.

20 Claims, 19 Drawing Sheets

(56) References Cited

FOREIGN PATENT DOCUMENTS

| | | | |
|---|---|---|---|
| KR | 20-0443480 | Y1 | 2/2009 |
| KR | 10-0987907 | B1 | 10/2010 |
| WO | WO 2017/161337 | | 9/2017 |

* cited by examiner

QUICK EXCHANGE IMAGE FRAME ASSEMBLY AND RELATED METHODS

CROSS-REFERENCE TO RELATED APPLICATION(S)

This application claims priority to U.S. Provisional Patent Application No. 62/309,841 filed Mar. 17, 2016, the disclosure of which is incorporated in its entirety by reference herein.

BACKGROUND

Picture frames are a common item used for the decoration and display of many types of images, such as artwork, photo prints, posters, etc. However, with conventional frames, inserting images into the frame and/or changing images within the frame is typically inconvenient and/or difficult because the frame requires almost a full disassembly in order to access and remove and replace a current image in the image frame with a new image.

For example, when using a conventional frame, a user must remove the frame from a wall, find a flat stable location to lay the frame face down, risk damage to a working surface or the frame, and remove any backing materials (e.g., cardboard backing held with metal tabs) that support the image. For example, the backing material is commonly installed with flexible metal tabs and/or staples that a user is required to bend (e.g., bend with a screw driver) in order to access an image within the frame. Furthermore, due to the need to bend the metal tabs and/or staples, the image within the frame, the frame and the glass often sometimes damaged (or at risk of damage) in the process of removing and/or replacing the image. Furthermore, after replacing the image, the backing material must be replaced, the metal tabs and/or staples re-bent, and the frame rehung on the wall.

Due to the inconvenience inherent in changing images within conventional frames, users tend to avoid changing images. In particular, many users may prefer to simply buy a new frame for new pictures, rather than deal with the time and hassle required for changing an image using conventional picture frames. As such, the decoration utility of conventional frames often becomes stale and mundane over time.

Accordingly, these and other disadvantages exist with respect to conventional image frames.

SUMMARY

The various embodiments described below provide benefits and/or solve one or more of the foregoing or other problems with conventional picture frames. For example, one or more embodiments described herein include an image frame assembly that allows for a quick and simple method for replacing images within the image frame assembly without removing the image frame assembly from a wall (e.g., a wall upon which the image frame assembly is hung) and without a need for removing backing material from the image frame assembly.

For instance, one or more embodiments of the present disclosure includes an image frame assembly having a frame portion that is rotatably coupled to a backing panel that can be attached to (e.g., hung from) a wall. The backing panel includes a plurality of biased members that apply pressure to an image within the image frame assembly to hold the image in place (e.g., against a glass pane and/or rabbet portion of the image frame assembly). As a result, in order to insert and/or exchange an image within the image frame assembly, a user lifts the frame portion from (e.g., rotates the frame portion relative to) the backing panel (e.g., opens the image frame assembly), if necessary, removes an image from within the image frame, places a new image in the image frame (against the glass or rabbet), and lowers the frame portion against the backing panel (e.g., closes the image frame assembly). Accordingly, because the image frame assembly of the present disclosure enables a user to exchange images within an image frame assembly without removing backing material and without removing the image frame assembly from a wall, the image frame assembly of the present disclosure provides and easier, faster, and more simple method of exchanging images within an image frame assembly while reducing or eliminating the risk of damage to the image and/or frame itself.

Additional features and advantages of the embodiments will be set forth in the description that follows, and in part will be obvious from the description, or may be learned by the practice of such example embodiments. The features and advantages of such embodiments may be realized and obtained by means of the instruments and combinations particularly pointed out in the appended claims. These, and other features, will become more fully apparent from the following description and appended claims, or may be learned by the practice of such example embodiments as set forth hereinafter.

BRIEF DESCRIPTION OF THE DRAWINGS

The detailed description is described with reference to the accompanying drawings in which.

DETAILED DESCRIPTION

Figure 1:
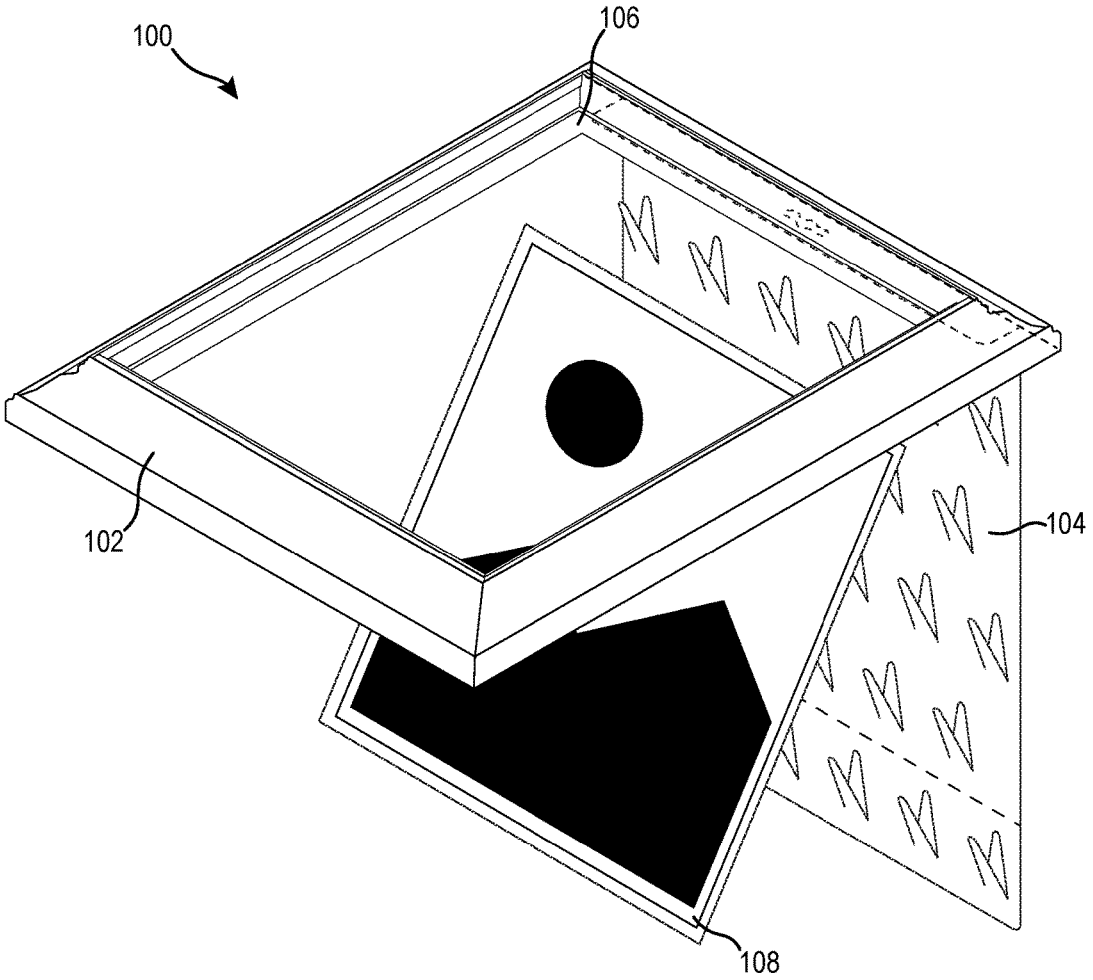
FIG. 1 shows a perspective view of an image frame assembly according to one or more embodiments of the present disclosure.

The various embodiments described herein provide an image frame assembly (e.g., picture frame) that enables a user to quickly and simply place an image (e.g., photo print) in the image frame assembly and/or exchange an image within the image frame. In some embodiments, an image frame assembly includes a frame portion (e.g., outer frame) that is rotatably coupled (e.g., attached) to a backing panel having a plurality of biased members for holding an image within the frame portion. In additional embodiments, the image frame assembly includes a frame portion that is rotatably coupled to a plurality of connected backing panels, each backing panel having a plurality of biased members for holding an image within the frame portion.

As noted above, in some embodiments, the image frame assembly includes a frame portion that is rotatably coupled to a backing panel having a plurality of biased members for holding an image within the frame portion. In one or more embodiments, the backing panel may include a hinge portion, for example, a movable joint or mechanism about which an attached member rotates as it opens and closes. Specifically, the frame portion may be coupled (e.g., connected) to the hinge portion such that the frame portion may rotate about an axis of rotation of the hinge portion. As such, the hinge portion allows the frame portion to rotate with respect to the backing panel allowing a user to "open" the frame assembly by rotating the frame portion away from the backing panel, as well as allowing a user to "close" the frame assembly by rotating the frame portion towards the backing panel.

Furthermore, as mentioned above, the backing panel includes a plurality of biased members. In particular, the plurality of biased members extend from the backing panel to provide support for an image within the image frame assembly (e.g., press the image up against a transparent panel (e.g., glass pane) and/or rabbets of the frame portion). In some embodiments, the biased members have a non-load position that extends away from the backing panel and towards the frame portion, or more particularly, towards a transparent panel of the frame portion. When a user closes the frame assembly, the biased members are placed in a load positioned to exert a force against the transparent panel, and accordingly, when an image is placed between the backing panel and the transparent panel, the biased members hold the image is in place against the transparent panel.

In view of the foregoing, in operation, a user may open the image frame assembly while hung on a surface (e.g., hung on a wall) by merely rotating (i.e., swinging) the frame portion (e.g., lifting the frame portion) about the hinge portion in a first direction (e.g., away from the backing panel) to release an image that was held between the biased members of the backing panel and the frame portion (e.g., a transparent panel), and remove the image from within the frame assembly. For instance, when the frame assembly is open, the backing panel remains against (e.g., flat against) the wall, thereby releasing the image and providing the user access to grasp the image and remove the image from the frame assembly.

Additionally, when the frame assembly is open, the user may place an image within the image frame assembly (e.g., against the plurality of biased members or against the glass pane and/or rabbet of the image frame). Once an image is placed within the image frame assembly, the user may close the image frame assembly by rotating the frame portion about the hinge portion in a second opposite direction (e.g., toward the backing panel). By closing the image frame assembly, the plurality of biased members of the backing panel press the image up against the transparent panel and/or rabbets of the frame portion, and thus, hold the image in place within the frame assembly.

In, additional embodiments, the image frame assembly includes a frame portion that is rotatably coupled to a plurality of connected backing panels each having a plurality of biased members for holding an image within the frame portion. In particular, a plurality of backing panels may be connected together via biased members of the backing panels as is discussed in greater detail below. As a result, multiple backing members can be connected together to accommodate differing sized frame portions and/or differing sized images. Accordingly, the image frame assembly of the present disclosure is advantageous over conventional image frames by providing a "one size fits all" backing panel.

Furthermore, in some embodiments, a user can use the unique backing panel disclosed herein to retrofit a conventional picture frame. For example, the backing panel disclosed herein is coupleable to a traditional frame portion of a conventional picture frame. Accordingly, a traditional frame can be retrofitted with the backing panel to impart at least some of the advantageous of the backing panel to the traditional picture frame.

Because the image frame assembly enables a user to remove, insert, and/or exchange an image within the image frame assembly while the image frame remains hung on a wall by merely rotating the frame portion about the hinge portion to open and close the frame assembly, the image frame assembly provides a more convenient, more simple, and faster method for removing, inserting and/or exchanging images within image frames in comparison to conventional picture frames. In particular, and unlike conventional picture frames, the image frame assembly avoids a full disassembly of the image frame assembly (e.g., unhanging the image frame, bending metal tabs, removing a backing material, replacing the backing material, and re-bending the metal tabs often required by conventional picture frames). As a result, the image frame assembly reduces time required to remove, insert, and/or exchange images within the image frame assembly in comparison to conventional picture frames, and thus, provides a more versatile and efficient framing option for users.

As used herein, the term "image" may refer to one or more of a picture, piece of artwork, photo print, poster, document, or similar display object of varying thickness or rigidity. For example, an image can include a print of a digital photo, a photograph from developed film, a poster, document for display, or any other type of object that can be displayed within an image frame. Accordingly, in general, the term image refers to any object having dimensions (i.e., length, width, and thickness) to be displayed using the image frame assembly described herein.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

As used herein, any relational terms such as "first," "second," and "third," "outer," "inner," "upper," "lower," "upward," "top," "bottom," "lateral," "longitudinal," etc., and derivative terms, are for clarity and convenience in understanding the present disclosure and accompanying drawings and do not connote or depend on any specific preference, orientation, or order, except where the context clearly indicates otherwise. For example, the relational terms may refer an orientation of an image frame assembly hung on a surface (e.g., a wall) in a typical fashion.

FIG. 1 shows a perspective partially exploded view of an image frame assembly according to one or more embodiments of the present disclosure. As illustrated, the image frame assembly 100 may include a frame portion 102, a backing panel 104, and a transparent panel 106. As shown in FIG. 1, the transparent panel 106 may be disposed within the frame portion 102 (e.g., within a viewing window defined by an outer frame of the frame portion 102). In some embodiments, the transparent panel 106 may be secured (e.g., attached) to the frame portion 102 via one or more of push points, edging strips, glue (e.g., hot glue), or any other adhesive, or mechanical means. Furthermore, the frame portion 102 may be coupled (e.g., attached) to the backing panel 104 along a frame member (e.g., an upper frame member) of the frame portion 102. In other embodiments, the frame portion 102 and the backing panel 104 may include a single uniform body (e.g., injected molded "unibody").

Additionally, as will be discussed in greater detail below, the frame portion 102 may be rotatably coupled to the backing panel 104 such that the frame portion 102 and the transparent panel 106 are rotatable relative to the backing panel 104. For example, the frame portion 102 may be rotated relative to the backing panel 104 (e.g., lifted up) in order to separate a lower portion (e.g., a lower frame member) of the frame portion 102 from the backing panel 104 (e.g., open the image frame assembly 100 as shown in FIG. 1). As will be discussed in greater detail below, upon opening the image frame assembly 100, an image 108 (e.g., a photo print) can be removed from the image frame assembly, inserted into the image frame assembly 100, and/or otherwise exchanged within the image frame assembly 100.

Figure 2A:
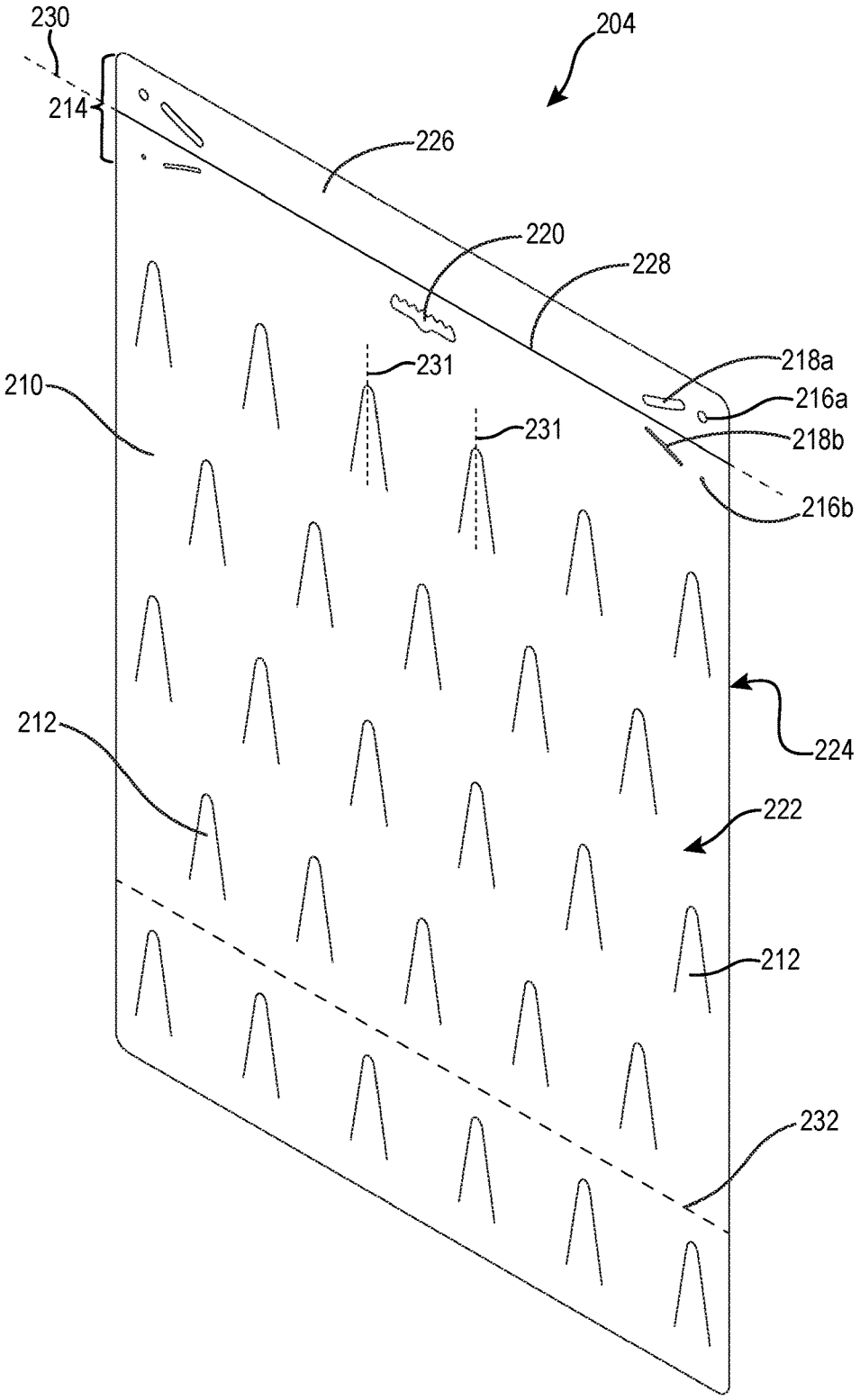
FIG. 2A shows a perspective view of a backing panel of an image frame assembly having a hinge portion in an extended position and a plurality of biased members according to one or more embodiments of the present disclosure.
Figure 2B:
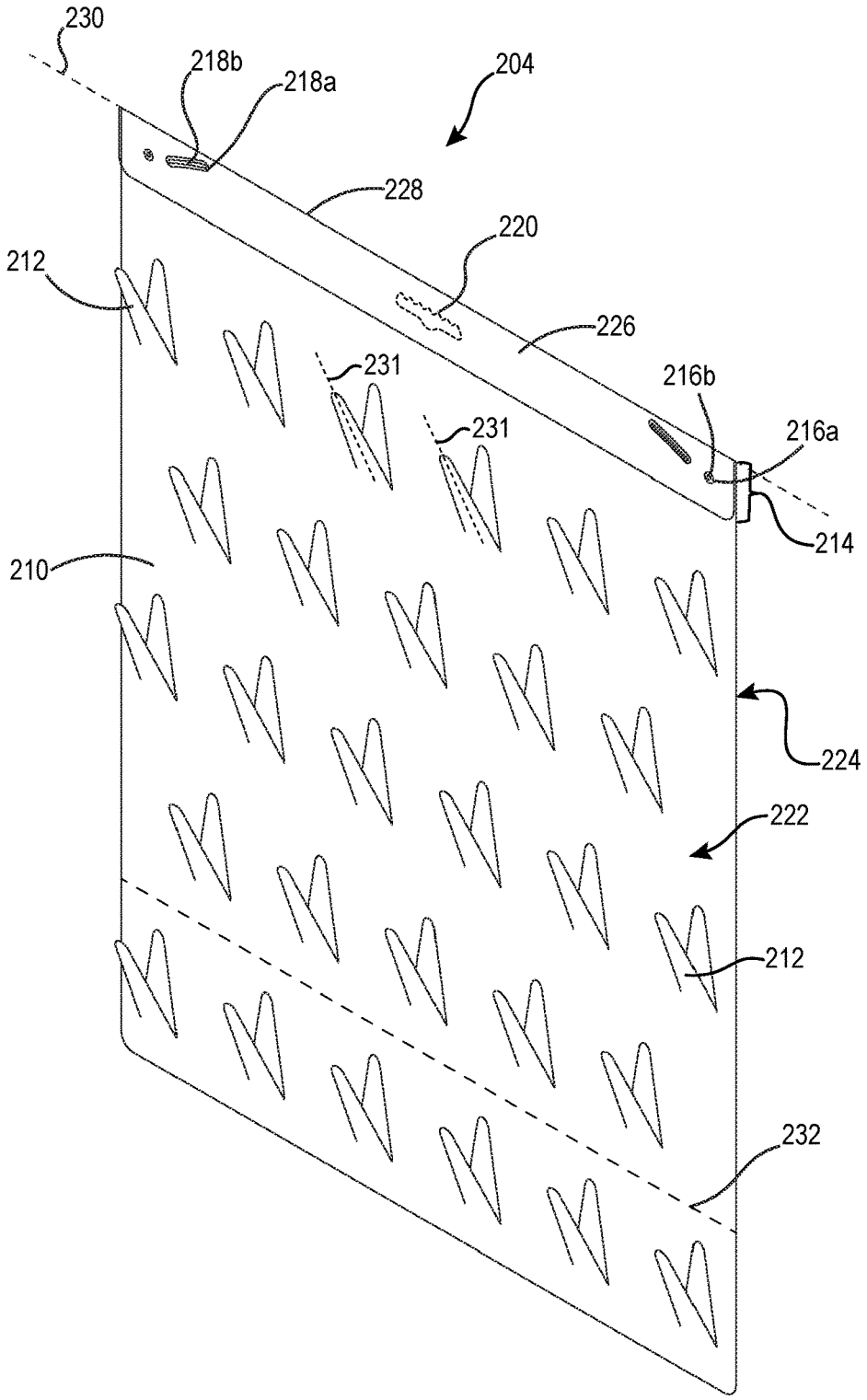
FIG. 2B shows a perspective view of the backing panel of FIG. 2A having the hinge portion in a folded position according to one or more embodiments of the present disclosure.

FIG. 2A illustrates a perspective view of a backing panel 204 of an image frame assembly according to one or more embodiments of the present disclosure. FIG. 2B illustrates another perspective view of the backing panel 204 of FIG. 2A. Referring to FIGS. 2A and 2B together, the backing panel 204 can include a body portion 210, a plurality of biased members 212, a hinge portion 214, a plurality of fastener apertures 216*a*, 216*b*, a plurality of relief apertures 218*a*, 218*b*, and a centered aperture 220.

As shown, the body portion 210 may include an inner surface 222 and an opposite parallel outer surface 224. The inner surface 222 of the body portion 210 may face a frame portion (e.g., frame portion 102) of an image frame assembly when the backing panel 204 is attached to the frame portion. Additionally, in some embodiments, the body portion 210 may be at least substantially planar (e.g., the inner surface 222 and outer surface 224 may be at least substantially parallel to each other and at least substantially planar).

Furthermore, as illustrated, the plurality of biased members 212 may be distributed throughout a plane defined by the inner surface 222 of the body portion 210. For example, the plurality of biased members 212 may be distributed throughout the plane in a pattern (e.g., array). Moreover, in some embodiments, the plurality of biased members 212 may be at least generally evenly (e.g., uniformly) spaced across the body portion 210. Although, in other embodiments, the plurality of biased members 212 may be distributed in what appears to be a random distribution across the body portion 210. Furthermore, although the backing panel 204 is described herein as having a plurality of biased members 212, the disclosure is not so limited. Rather, the backing panel 204, in some embodiments, may include a single biased member.

In some embodiments, each biased member of the plurality of biased members 212 may include a partial cutout (e.g., stencil cutout) of the body portion 210 of the backing panel 204. Furthermore, as shown in FIG. 2B, each biased member of the plurality of biased members 212 may be at least partially raised relative to the body portion 210 of the backing panel 204. For example, a portion of each biased member of the plurality of biased members 212 may be separated from the body portion 210 of the backing panel 204 by at least some distance. Specifically, each biased member of the plurality of biased members 212 may be attached to the body portion 210 of the backing panel 204 at a bottom (e.g., a base) of the biased member 212, and a top of each biased member of the plurality of biased members 212 may be separated from the body portion 210.

For instance, each biased member of the plurality of biased members 212 may be bent away from the from the body portion 210 of the backing panel 204. Additionally, when raised relative to the body portion 210 of the backing panel 204 and when the backing panel 204 is attached to a frame portion (e.g., frame portion 102), each biased member of the plurality of biased members 212 may extend toward the frame portion. Additionally, a longitudinal axis 231 of each biased member of plurality of biased members 212 may extend in an upward direction. As a result, the plurality of biased members 212 may be less likely to catch on (e.g., snag) images as the images are inserted (e.g., slid) into image frame assembly. Although, in other example embodiments, the plurality of biased members 212 may extend in a downward direction, sideward direction, or other direction as a particular application may dictate.

In addition, the backing panel 204 can include an amount of biased members 212 having dimensions that combine to create a load force to securely hold an image in place between the plurality of biased members 212 and the transparent panel 106 (FIG. 1) when the plurality of biased members 212 are pressed into contact with the transparent panel 106 (FIG. 1) (e.g., when the frame assembly 100 is in the closed position). For example, the amount of biased members 212 can vary from one embodiment to the next depending on the size and weight of an image or the size of the viewing window within the frame portion 102 (FIG. 1). In one or more embodiments, the number of biased members 212 is determined in order to provide an even distribution of the load force across the image 108 (FIG. 1) such that when viewing the image displayed in the frame assembly 100, the image does not show indications of the location of any particular biased member (e.g., any indentations).

Similarly, each of the plurality of biased members 212 have dimensions to provide an individual load force (e.g., the load force for an individual biased member) needed to generate the combined load force to securely hold an image in place between the plurality of biased members 212 and the transparent panel 106 when the plurality of biased members 212 are pressed into contact with the transparent panel 106 (e.g., when the frame assembly 100 is in the closed position). For example, the plurality of biased members 212 can include a base dimension (e.g., portion attached to the body portion 210) to create a sufficient load force to an image that, when combined with the individual load forces of the other biased members, holds the image in place within the frame portion. Per the principles described herein, it is appreciated that the base width, for example, will vary depending on the size and weight of the image to be displayed within the image frame assembly 100.

In addition to various base dimensions, the plurality of biased members 212 may have a sufficient extension length to accommodate various styles of frame portions (e.g., frame portions have differing depths). For example, depending on a particular frame portion 102 (FIG. 1) design, a distance between the backing panel 204 and the transparent panel 106 (FIG. 1) can vary. Accordingly, the extension length of the plurality of biased members 212 can be a length that, when the frame assembly is in a closed position, causes the biased members 212 to interact with the transparent panel 106 (FIG. 1) and generate a sufficient combined load force to securely hold an image between the backing panel 204 and the transparent panel 106 (FIG. 1).

As a non-limiting example, each biased member of the plurality of biased members 212 may have an at least general rounded triangle shape (e.g., rounded peak shape) with a base of the triangle shape being attached (e.g., still attached) to the body portion 210. Furthermore, in such embodiments, a peak portion of each biased member of the plurality of biased members 212 may be separated from the body portion 210 of the backing panel 204 by at least some distance. The plurality of biased members 212 are discussed in greater detail below in regard to FIGS. 7A-7E and 14.

In addition to the plurality of biased members 212, as mentioned above, the backing panel 204 includes the hinge portion 214. Furthermore, the hinge portion 214 may be disposed proximate a top edge of the backing panel 104. As will be discussed in greater detail below, the hinge portion 214 may include a folded portion of the backing panel 204. For example, the hinge portion 214 can include an upper segment 226 of the backing panel 204 folded back on the backing panel 204 (e.g., formed by a segment of the backing panel 204 folded back on itself). In some embodiments, the upper segment 226 may include an uppermost portion of the backing panel 204. Furthermore, in one or more embodiments, the hinge portion 214 may rotatable couple a frame portion (e.g., frame portion 102) to the backing panel 204.

In particular, and as shown in FIGS. 2A-2B, the hinge portion 214 may include a linear folding line 228 disposed at a boundary of the upper segment 226 (e.g., at a boundary of the upper segment 226 and the reminder of the backing panel 204) and extending across the body portion 210 (e.g., from a first lateral end to a second opposite lateral end of the backing panel 104) of the backing panel 204 and in a direction at least substantially parallel to a longitudinal edge of the backing panel 204. Additionally, in some embodiments, the folding line 228 may extend in a direction at least substantially perpendicular to a direction in which the longitudinal axes 231 of the plurality of biased members 212 extend. Accordingly, the hinge portion 214 of the backing panel 204 may be a foldable portion of the backing panel 204 where the upper segment is foldable toward the body portion 210 along the folding line 228, as illustrated in FIG. 2B. For example, the hinge portion 214 may have an open position (e.g., an unfolded position illustrated in FIG. 2A) and a closed position (e.g., the position illustrated in FIG. 2B). Moreover, the folding line 228 may define an axis of rotation 230 about which, when a frame portion (e.g., frame portion 102) is attached to the backing panel 204, the frame portion may rotate relative to the backing panel 104. In particular, in some embodiments, the axis of rotation 230 may be collinear with the folding line 228. Furthermore, when the backing panel 204 is hung on a surface, the axis of rotation 230 may extend in an at least substantially horizontal direction.

In operation, a frame portion (e.g., frame portion 102) may be coupled to the upper segment 226 of the hinge portion 214 of the backing panel 204. In particular, an upper frame member of the frame portion may be coupled to an outer surface 224 of the upper segment 226 of the hinge portion 214. Furthermore, once coupled to the hinge portion 214, the frame portion may be rotatable back and forth (e.g., opened and closed) about the axis of rotation 230. For example, a user may open an image frame assembly by lifting the frame portion and causing the hinge portion 214 to move (e.g., rotate) from a closed position (FIG. 2B) to an open position (FIG. 2A). Upon a user lifting the frame portion, the plurality of biased members 212 of the backing panel 204 may lose contact and/or release a pressure on an image within the image frame assembly such that a user can remove the image out of the image frame assembly. Furthermore, the user may close the frame assembly by lowering the frame portion and causing the hinge portion 214 to move (e.g., swing) from an extended position (FIG. 2A) to a folded position (FIG. 2B). The hinge portion 214 are described in greater detail below in regard to FIGS. 3A-4B.

Additionally, as noted above, the backing panel 204 may include the plurality of fastener apertures 216*a*, 216*b*, the plurality of relief apertures 218*a*, 218*b*, and the centered aperture 220. Furthermore, the plurality of fastener apertures 216*a*, 216*b*, the plurality of relief apertures 218*a*, 218*b*, and the centered aperture 220 may be disposed proximate the upper edge of the backing panel 204 and may extend through the body portion 210 (e.g., extend from the inner surface 222 to the outer surface 224 of the backing panel 204). In some embodiments, the plurality of fastener apertures 216*a*, 216*b*, the plurality of relief apertures 218*a*, 218*b*, and the centered aperture may also extend through the hinge portion 214 of the backing panel 104.

In one or more embodiments, the plurality of fastener apertures 216*a*, 216*b* and the plurality of relief apertures 218*a*, 218*b* may be oriented proximate to lateral ends of the backing panel 204. Furthermore, in some embodiments, the plurality of fastener apertures 216*a*, 216*b* may include a first fastener aperture 216*a* on one side of the folding line 228 (e.g., extending through the upper segment 226 of the hinge portion 214) and a second corresponding fastener aperture 216*b* on an opposite side of the folding line 228. Moreover, the first fastener aperture 216*a* and the second corresponding fastener aperture 216*b* may be oriented such that when the hinge portion 214 is folded along the folding line 228, the first fastener aperture 216*a* and the second corresponding fastener aperture 216*b* are aligned such that a fastener (e.g., a nail) can extend through the second corresponding fastener aperture 216*b* and at least partially through the first fastener aperture 216*a* simultaneously.

For example, as shown in FIG. 2A, in some embodiments, the first fastener aperture 216*a* may be larger in circumference than the second corresponding fastener aperture 216*b*. As a result, when a fastener (e.g., a nail) is extending through the second corresponding fastener aperture 216*b* (e.g., fastening the backing panel 204 to a wall), a head of the fastener may extend through (e.g., rest within) the first fastener aperture 216*a*. For instance, when the hinge portion 214 is in a folded position, the head of the fastener may be disposed within the first fastener aperture 216*a* allowing the inner surface 222 of the hinge portion to be at least substantially flat against the inner surface 222 of the body portion 210 of the backing panel 204. Described another way, the first fastener aperture 216*a* may act as a countersink hole for the fastener to help prevent the head of the fastener from interfering with the coupling of a frame portion (e.g., frame portion 102) to the hinge portion 214.

Similarly, in one or more embodiments, the plurality of relief apertures 218*a*, 218*b*, may include a first relief aperture 218*a* on one side of the folding line 228 and a second corresponding relief aperture 218*b* on an opposite side of the folding line 228. Furthermore, the first relief aperture 218*a* and the second corresponding relief aperture 218*b* may be oriented such that when the hinge portion 214 is folded along the folding line 228, the first relief aperture 218*a* and the second corresponding relief aperture 218*b* are aligned. In some embodiments, the plurality of relief apertures 218*a*, 218*b* may provide flexibility within the hinge portion 214 of the backing panel 104 and may reduce stress to which the hinge portion 214 may be subjected to due to fasteners extending through the plurality of fastener apertures 216*a*, 216*b*.

In some embodiments, the centered aperture 220 may include a saw-tooth edged hole. Specifically, an upper edge of the centered aperture 220 may include a saw-tooth shape for gripping fasteners extending through the centered aperture 220 (e.g., fasteners already coupled to a wall). In one or more embodiments, the centered aperture may only extend through a portion of the hinge portion 214 below the folding line 228 such that, when the hinge portion 214 is in a folded position, the centered aperture 220 is at least partially obscured by the upper segment 226 of the hinge portion 214.

Referring still to FIGS. 2A and 2B together, in some instances, the backing panel 204 includes a perforation line 232 extending across a lower portion of the backing panel. For example, the perforation line 232 may extend from one lateral side of the backing panel 204 to an opposite lateral side of the backing panel 204. The perforation line 232 may allow a user to remove a portion of the backing panel 204 to fit a size of a given frame portion (e.g., a frame portion smaller than the backing panel 204). In additional embodiments, the perforation line 232 may allow a user to fold the backing panel 104 along the perforation line 216 in order to fit a size of a given frame portion. In additional examples, the backing panel can include multiple perforation lines at different intervals to allow a user to remove or fold along a particular perforation line of the multiple perforation lines to customize the size of the backing panel 204 to a particular frame portion size.

In one or more embodiments, the backing panel 204 may be formed from a semi-flexible planar material. For example, the backing panel 104 may include a plastic such as one or more of Polyethylene Terephthalate, High-Density Polyethylene, Low-Density Polyethylene, Polyvinyl Chloride, Polypropylene, Polystyrene, Polycarbonate, and Polylactide. In additional embodiments, the backing panel 104 may include one or more pliable materials such as, for example, rubber, foam rubber, and/or metal alloys. Additionally, the backing panel 204 may have one or more of a general rectangular shape, circular shape, or any other geometric shape.

Figure 3A:
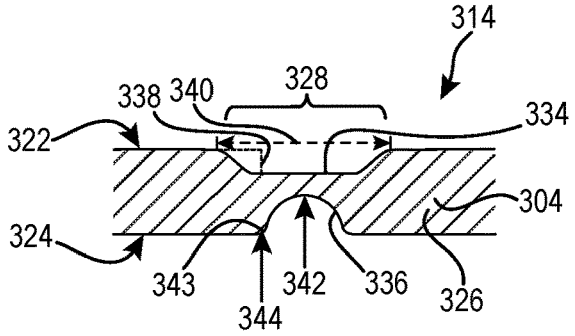
FIG. 3A shows a partial side cross-sectional view of a hinge portion of a backing panel according to one or more embodiments of the present disclosure.

FIG. 3A shows a partial side cross-sectional view of a hinge portion 314 of a backing panel of an image frame assembly according to one or more embodiments of the present disclosure. As showing in FIG. 3A, a folding line 328 may include a narrowed portion of the hinge portion 314. For example, the folding line 328 of the hinge portion 314 may include a first linear recess 334 (e.g., an at least generally uniform first linear recess) extending from the inner surface 322 of the backing panel 304 and into the backing panel 304, and a second linear recess 336 (e.g., an at least generally uniform second linear recess) extending from the outer surface 324 of the backing panel 304 and into the backing panel 304. Furthermore, the backing panel 304 may include at least some material between the first linear recess 334 (e.g., a bottom of the first linear recess) and the second linear recess 336 (e.g., a bottom of the second linear recess). For instance, neither the first linear recess 334 nor the second linear recess 336 may extend completely through the backing panel 304. In alternative embodiments, the folding line 328 may include a perforated line and may include apertures extending completely through the backing panel 304.

In some embodiments, the first linear recess 334 may be relatively shallow and may have a depth 338 within a range of about 0.0002 inches to about 0.0010 inches. For example, the first linear recess 334 may have a depth 338 of about 0.0006 inches. Furthermore, the first linear recess 334 may have a maximum width 340 within a range of about 0.035 inches to about 0.085 inches. For instance, the first linear recess 334 may have a maximum width 340 of about 0.060 inches. In other embodiments, the dimensions of the first linear recess 334 may be larger or smaller depending on a specific application or depending on the type of material used to form the backing panel 304.

Additionally, in one or more embodiments, the second linear recess 336 may have an at least general semi-circular shaped cross-section when viewed from a plane orthogonal to a direction in which the folding line 328 extends (e.g., the view illustrated in FIG. 3A). Furthermore, the second linear recess 336 may have a radius 342 within a range of about 0.020° to about 0.040°. Additionally, in some instances, intersections 343 of the second linear recess 336 with the outer surface 324 of the backing panel 304 (e.g., the edges of the second linear recess) may be rounded and may have a radius 344 within range of about 0.0025 inches to about 0.0075 inches. For example, the intersections 343 may have a radius 344 of about 0.005 inches. In other embodiments, the dimensions of the second linear recess 334 may be larger or smaller depending on a specific application or depending on the type of material used to form the backing panel 304.

In operation, the first linear recess 334 and the second linear recess 336 may allow the hinge portion 314 to more easily fold along the folding line 328. For example, the first linear recess 334 and the second linear recess 336 may allow an inner surface 322 of the upper segment 326 of the hinge portion 314, when folded along the folding line 328, to be at least substantially parallel with the inner surface 322 of the backing panel 304. For instance, the first linear recess 334 and the second linear recess 336 may allow the upper segment 326 of the hinge portion 214 to be at least substantially flat against the inner surface 322 of the backing panel 304.

Figure 3B:
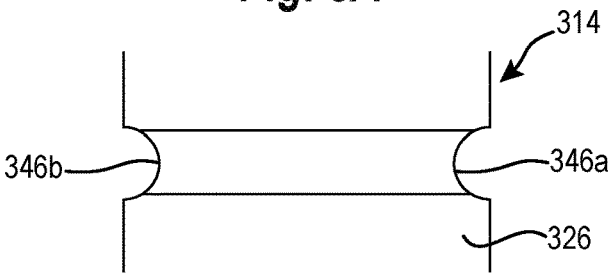
FIG. 3B shows a side view of the hinge portion of FIG. 3A according to one or more embodiments of the present disclosure.

FIG. 3B shows a partial bottom side view (e.g., a view of the outer surface 324 of the backing panel 304) of the hinge portion 314 of FIG. 3A according to one or more embodiments of the present disclosure. As shown in FIG. 3B, in some embodiments, the second linear recess 336 may include semi-circular shaped indentions 346*a*, 346*b* (e.g., cutouts) at each end of the folding line 328 and extending from an outer edge of the backing panel 304 toward a center of the backing panel 304. During use, the indentions 346*a*, 346*b* may assist in preventing the hinge portion 314 from tearing along the folding line 328.

Figure 4A:
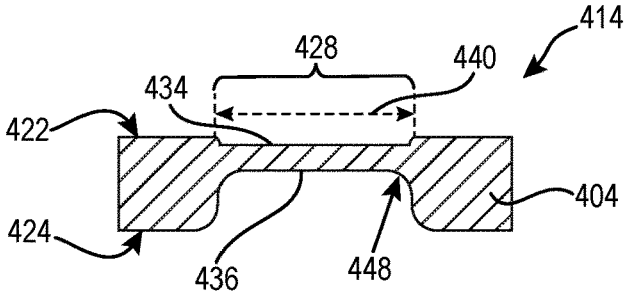
FIG. 4A shows a partial side cross-sectional view of a hinge portion of a backing panel according to another embodiment of the present disclosure.
Figure 4B:
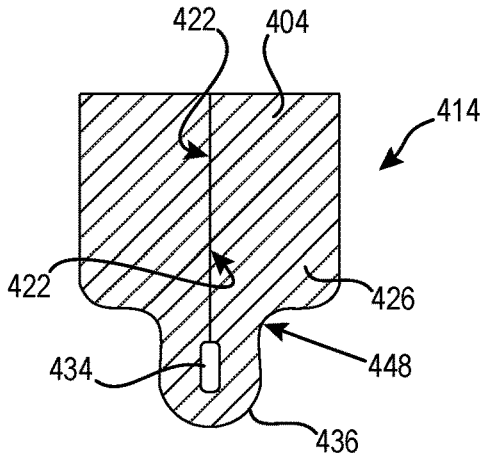
FIG. 4B shows a partial side cross-sectional view of the hinge portion of FIG. 4A in a folded position according to one or more embodiments of the present disclosure.

FIG. 4A shows a partial side cross-sectional view of a hinge portion 414 in an extended position according to other embodiments of the present disclosure. FIG. 4B shows a partial side cross-sectional view of the hinge portion 414 of FIG. 4A in a folded position. Similar to the hinge portion of FIGS. 3A and 3B, the hinge portion 414 may include a folding line 428 having a first linear recess 434 (e.g., an at least generally uniform first linear recess) extending from the inner surface 422 of the backing panel 404 and into the backing panel 404, and a second linear recess 436 (e.g., an at least generally uniform second linear recess) extending from the outer surface 424 of the backing panel 404 and into the backing panel 404.

Furthermore, the first linear recess 434 may be similar to the first linear recess 334 of FIG. 3A and may be relatively shallow and may have a depth within a range of about 0.0002 inches to about 0.0010 inches. Furthermore, the first linear recess 434 may have a maximum width 440 within a range of about 0.035 inches to about 0.085 inches. In other embodiments, the dimensions of the first linear recess 434 may be larger or smaller depending on a specific application or depending on the type of material used to form the backing panel 404.

The second linear recess 436 may have an at least general rounded rectangular cross-section when viewed from a plane orthogonal to a direction in which the folding line 428 extends (e.g., the view illustrated in FIG. 4A). Furthermore, inner rounded corners of the second linear recess 436 may have a radius 448 within a range of about 0.020° to about 0.040°. In other embodiments, the dimensions of the second linear recess 436 may be larger or smaller depending on a specific application or depending on the type of material used to form the backing panel 404.

In operation, the first linear recess 434 and the second linear recess 436 may allow the hinge portion 414 to more easily fold along the folding line 428. For example, first linear recess 434 and the second linear recess 436 may allow an inner surface 422 of the upper segment 426 of the hinge portion 414, when folded along the folding line 428, to be at least substantially parallel with the inner surface 422 of the backing panel 404 (FIG. 4B). For instance, the first linear recess 434 and the second linear recess 436 may allow the upper segment 426 of the hinge portion 414 to be at least substantially flat against the inner surface 422 of the backing panel 404. Furthermore, the first linear recess 434 and the second linear recess 436 may, when the hinge portion 414 is folded along the folding line 428, cause a stress experienced within the folding line 428 to be at least substantially uniform throughout a length the folding line 428. As a result, the first linear recess 434 and the second linear recess 436 may help to prevent failure (e.g., breaking and/or tearing) of the hinge portion 414 during use.

Figure 5A:
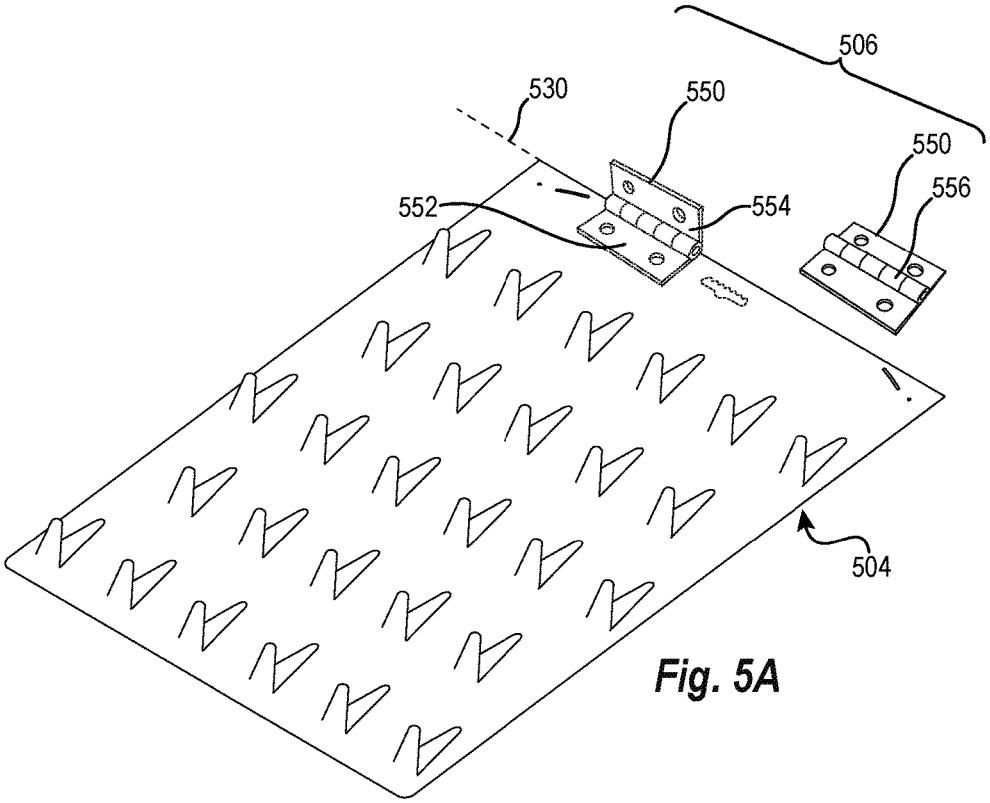
FIG. 5A shows a perspective view of a backing panel of an image frame assembly having one or more hinges attached thereto according to one or more embodiments of the present disclosure.
Figure 5B:
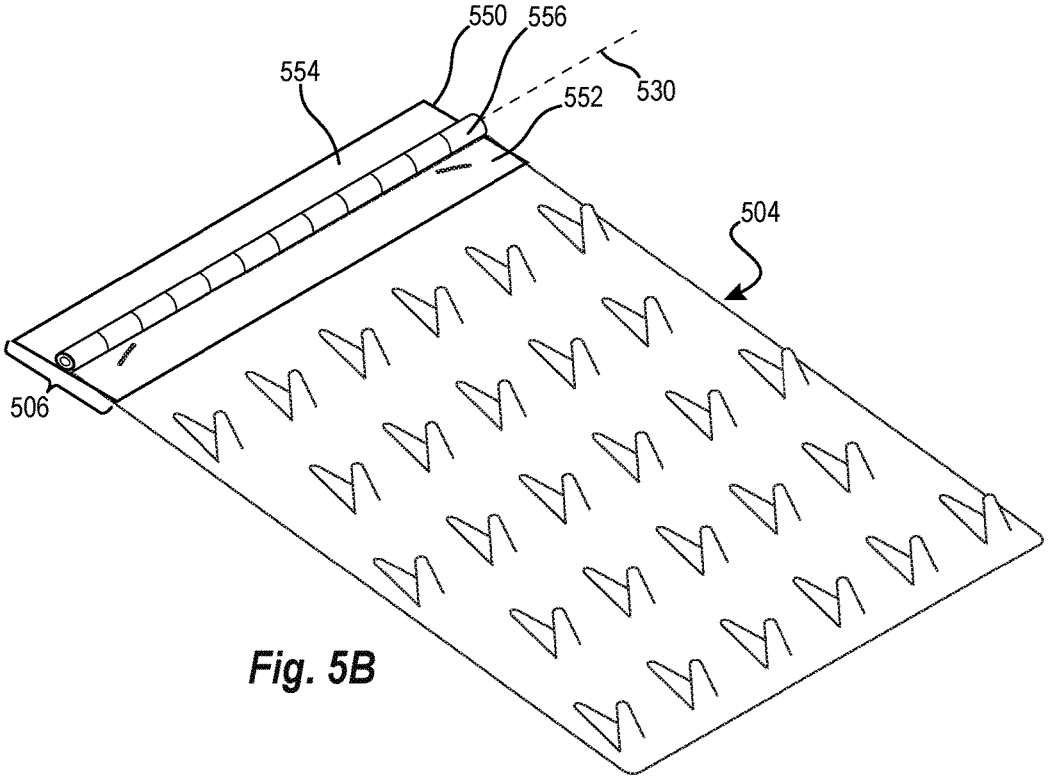
FIG. 5B shows a perspective view of a backing panel of an image frame assembly having a single hinge attached thereto according to one or more embodiments of the present disclosure.

FIG. 5A illustrates a backing panel 504 and hinge portion 506 according to another embodiment of the present disclosure. FIG. 5B illustrates a backing panel 504 and hinge portion 506 according to yet another embodiment of the present disclosure. As shown in FIGS. 5A and 5B, in some embodiments, the hinge portion 506 can include one or more butt hinges 550 having a first leave 552 of a given butt hinge 550 attached to the backing panel 504 and a second leave 554 of the given butt hinge 550 attached to the frame portion (e.g., frame portion 102) of an image frame assembly. In such embodiments, an axis of rotation 530 about which the frame portion can rotate relative to the backing panel 504 can be defined by a center of each knuckle 556 of a given butt hinge 550. In some embodiments, the one or more butt hinges 550 may include one or more of a plastic and metal material. Furthermore, the one or more butt hinges 550 may be attached to the backing panel 504 via an adhesive. Moreover, the one or more butt hinges 550 may be attached to the frame portion (e.g., frame portion 102) via one or more of an adhesive and a mechanical fastener.

Figure 6:
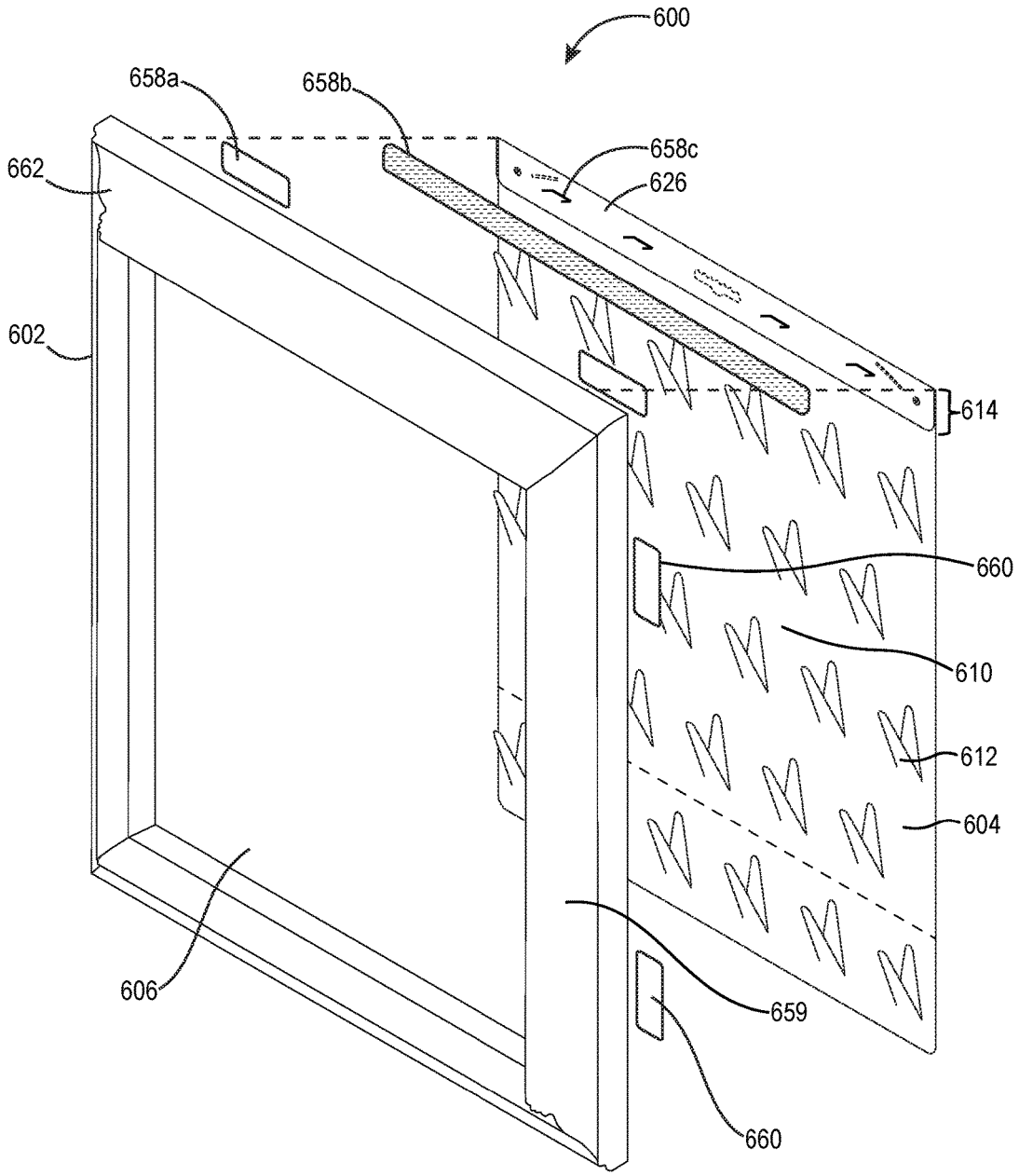
FIG. 6 shows a perspective exploded view of an image frame assembly according to one or more embodiments of the present disclosure.

FIG. 6 illustrates a perspective exploded view of an image frame assembly 600 having one or more securing elements for attaching (e.g., securing) a frame portion 602 and a transparent panel 606 to a backing panel 604 (e.g., a backing panel 604 having a plurality of biased members 612). As shown, in some embodiments, the one or more securing elements 658 can include a single strip of material 658*b* disposed between an upper frame member 662 of the frame portion 602 and an upper segment 626 of the hinge portion 614 of the backing panel 604. In additional embodiments, the one or more securing elements 658 can include a plurality of strips of material 658*a* disposed between an upper frame member 662 of the frame portion 602 and the upper segment 626 of the hinge portion 614 of the backing panel 604. In further embodiments, the one or more securing elements 658 can include mechanical fasteners 658*c* such as screws, nails, staples, tacks, etc.

In embodiments including the single strip of material 658*b* and/or a plurality of strips of material 658*a*, in some embodiments, the strip(s) of material 658*a*, 658*b* can include hook and loop fastening material (e.g., VELCRO). In additional embodiments, the strip(s) of material 658*a*, 658*b* can include an adhesive material (e.g., a permanent and/or semi-permanent adhesive material). Furthermore, in one more embodiments, the adhesive material may include pressure sensitive adhesives (e.g., adhesives that form a bond when pressure is applied to join the adhesive with an adhered) (referred to hereinafter as "PSAs"). In some embodiments, the adhesive material may include one or more of solvent-based PSAs and water-based PSAs. Specifically, the adhesive material may include one or more elastomers and tackifiers. The elastomers of the adhesive material may include one or more elastomers such as acrylics, bio-based acrylate, butyl rubber, ethylene-vinyl acetate, natural rubber, nitriles, silicone rubbers, synthetic rubbers, styrene block copolymers, and vinyl ethers. In one or more embodiments, the adhesive material may include one or more of styrene-butadiene-styrene (SBS), styrene-ethylene/butylene-styrene (SEB S), Styrene-ethylene/propylene (SEP), and styrene-isoprene-styrene (SIS). Furthermore, the tackifiers of the adhesive material may include one or more tackifiers such as "MQ" silicate resins, cumarone-indene, α-methyl styrene, vinyl toluene, aliphatic olefins, rosin esters, polyterpenes, and terpene phenolics. In yet further embodiments, the strips of material 658*a*, 658*b* can include biomechanical adhesives, gels, films, etc.

Referring still to FIG. 6, the image frame assembly 600 can include the one or more detachable securing elements 660 between a lateral side member of the frame portion 602 and the body portion 610 of the backing panel 604. The detaching securing elements 660 may secure (e.g., fix) the frame portion 602 relative to the backing panel 604 of the image frame assembly 600 while allowing the frame portion 602 to be relatively easily detached from the backing panel 604 along the side members 659 of the frame portion 602. For example, the detaching securing elements 660 may allow for the frame portion 602 to be easily rotated about the hinge portion 614 of the backing panel 604 in order to remove, insert, and/or exchange an image (e.g., image 108) within the image frame assembly 600. For instance, detaching securing elements 660 may include one or more of a hook and loop material and/or a tacky adhesive material such that the detaching securing elements 660 allow the frame portion 602 to be easily detached from and reattached to the body portion 610 of the backing panel 604.

Figure 7A:
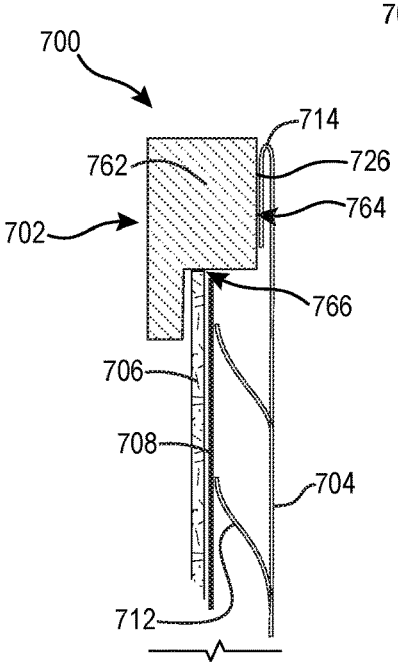
FIGS. 7A-7E show partial side cross-sectional views of various embodiments of biased members of the backing panel of an image frame assembly according to one or more embodiments of the present disclosure.

FIG. 7A illustrates a partial side cross-sectional view of an image frame assembly 700 have an image 708 disposed therein according to one or more embodiments of the present disclosure. As shown in FIG. 7A, the frame portion 702 may include an upper member 762 (e.g., an upper piece of a molding of the frame portion 702), and the upper member 762 may include a back surface 764 to which the backing panel 704 (e.g., the upper segment 726 of the hinge portion 714) can be attached and a rabbet portion 766 (e.g., notch and/or lip) for supporting the image 708 and obscuring edges of the image 708. As will be appreciated by one of ordinary skill in the art, each other member of the frame portion 702 (side members and lower member) may also include a respective back surface and rabbet portion for supporting the image 708.

Additionally, the plurality of biased members 712 (e.g., the at least general rounded triangle shaped members) may press the image 708 against the transparent panel 706 (e.g., pane of glass), and, as a result, may hold the image 708 within the rabbet portion 766 of the frame portion 702 (e.g., keep the image supported within the frame portion via mechanical interference). Furthermore, because the plurality of biased members 712 are at least generally uniformly distributed throughout the backing panel 704, the plurality of biased members 712 may uniformly press the image 708 against the transparent panel 706, thus, giving the image 708 a generally flat appearance through a viewing window of the image frame assembly 700. For example, because the plurality of biased members 712 are at least generally uniformly distributed throughout the backing panel 704, the plurality of biased members 712 may not distort and/or cause unsightly "denting" of the image 708 while the image 708 is within the image frame assembly 700.

Figure 7B:
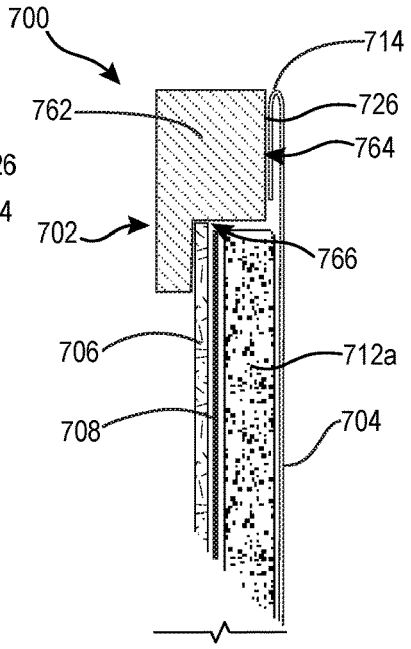

FIG. 7B illustrates a partial side cross-sectional view of an image frame assembly 700 have an image 708 disposed therein according to another embodiment of the present disclosure. As shown in FIG. 7B, in some embodiments, the image frame assembly 700 may include a single biased member 712*a*, and the single biased member 712*a* may include a compressible material. For example, the compressible material can include one or more of a foam material (e.g., a Polyurethane and/or Polyethylene foam), STYROFOAM, bubble wrap, a cushion, etc. Furthermore, similar to the plurality of biased members 712, the single biased member 712*a* may press the image 708 against the transparent panel 706, and, as a result, may hold the image 708 within the rabbet portion 766 of the frame portion 702.

Figure 7C:
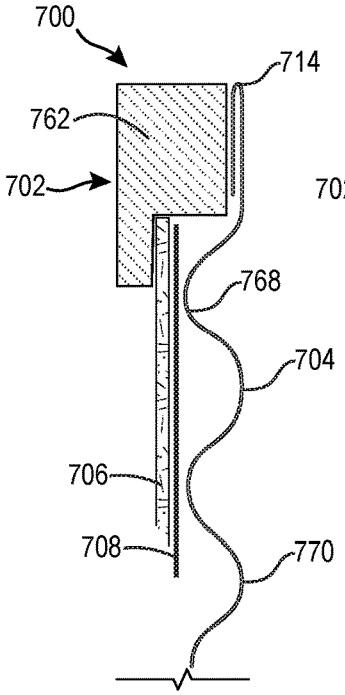

FIG. 7C illustrates a partial side cross-sectional view of an image frame assembly 700 have an image 708 disposed therein according to another embodiment of the present disclosure. As shown in FIG. 7C, the backing panel 704 may have an at least general sinusoidal shaped cross-section. For example, the cross-section of the backing panel 704 may defined a plurality of peaks 768 and plurality of valleys 770 (e.g., a corrugated shape). Furthermore, each peak and valley pair of the plurality of peaks 768 and the plurality of valleys 770 may define a biased member of the plurality of biased members 712. In particular, the plurality of peaks 768 may abut up against a back of the image 708 and may press the image 708 against the transparent panel 706, and, as a result, may hold the image 708 within the rabbet portion 766 of the frame portion 702. In such and embodiment, the backing panel 704 does not include any cutouts to form the biased members 712, but rather, the biased members 712 are the plurality of peaks 768 formed by the corrugated shape of the backing panel 704.

Figure 7D:
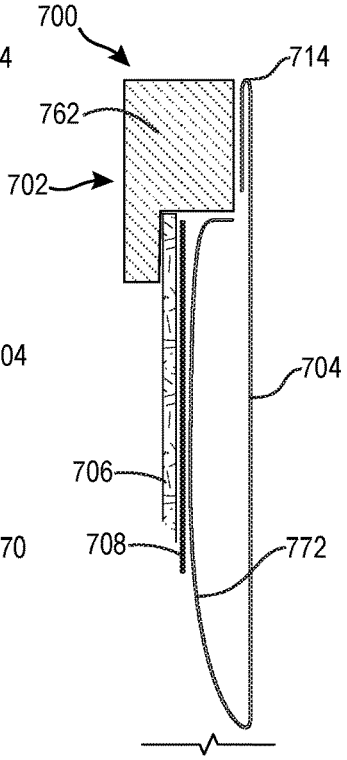

FIG. 7D illustrates a partial side cross-sectional view of an image frame assembly 700 have an image 708 disposed therein according to another embodiment of the present disclosure. As shown in FIG. 7D, the backing panel 704 may define one or more flaps 772, and the one or more flaps 772 may abut up against a back of the image 708 and may press the image 708 against the transparent panel 706. As a result, the one or more flaps 772 may hold the image 708 within the rabbet portion 766 of the frame portion 702.

Figure 7E:
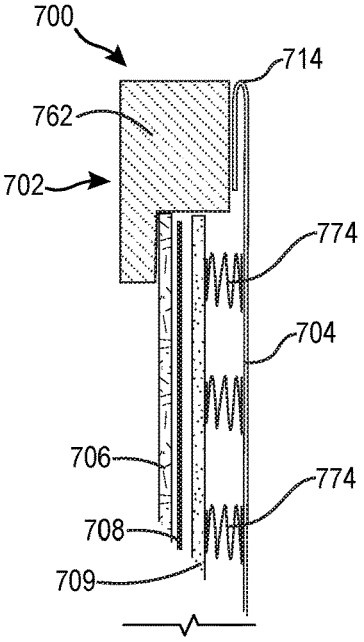

FIG. 7E illustrates a partial side cross-sectional view of an image frame assembly 700 have an image 708 disposed therein according to yet another embodiment of the present disclosure. As shown in FIG. 7E, the plurality of biased members may include one or more spring members 774 attached to backing panel 704 on one end and attached to a supporting panel 709 on an opposite end. In some embodiments, each spring member 774 may include a helical spring. Furthermore, the spring members 774 may cause the supporting panel 709 to abut up against a back of the image 708 and, as a result, may press the image 708 against the transparent panel 706. Moreover, because the spring members 774 cause the supporting panel 709 to press the image 708 against the transparent panel 706, the spring members 774 may hold the image 708 within the rabbet portion 766 of the frame portion 702.

Figures 8A, 8B, 8C, 8D:
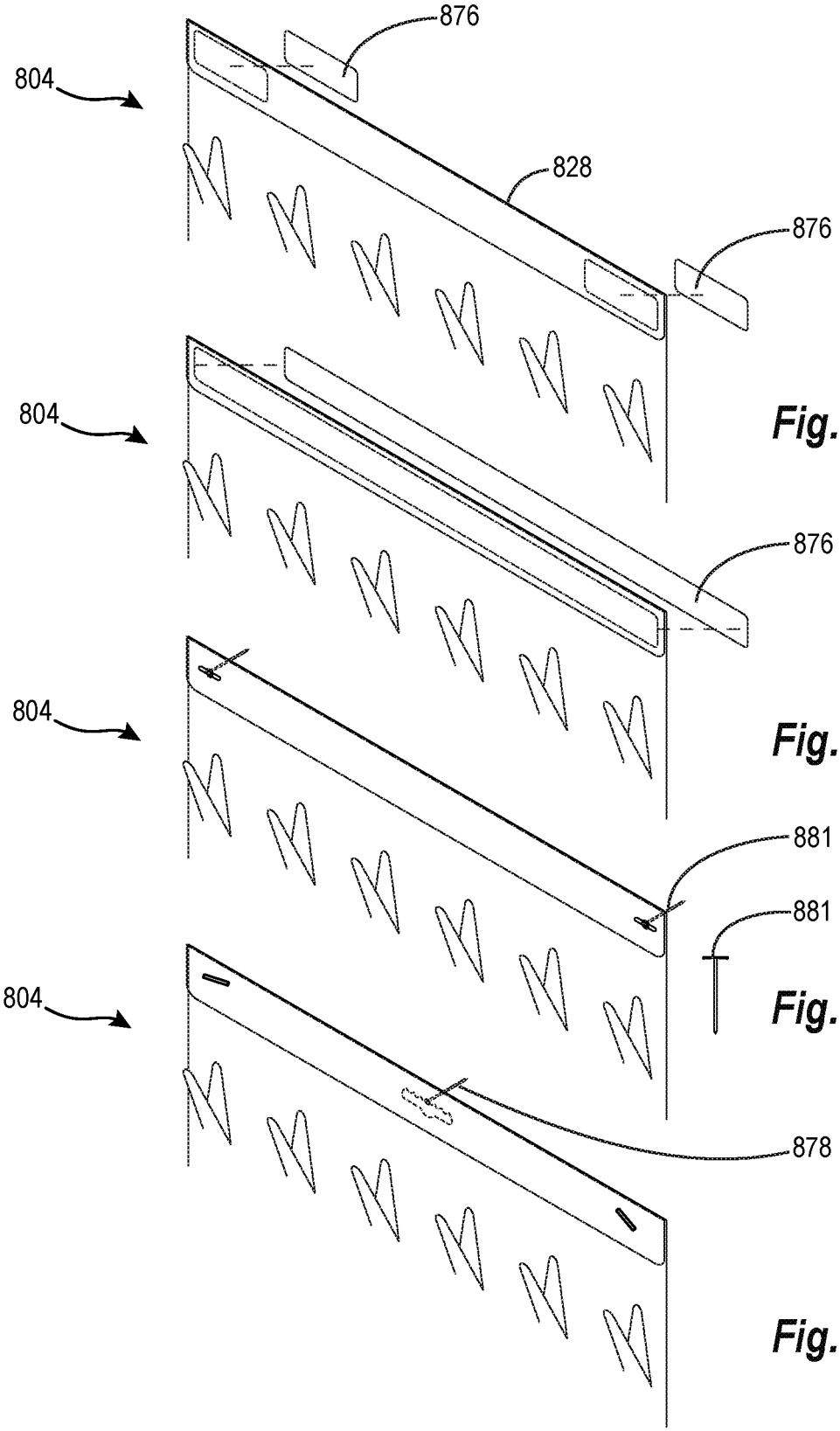
FIGS. 8A-8D show partial perspective views of various embodiments of coupling elements for coupling a backing panel of an image frame assembly to a surface according to one or more embodiments of the present disclosure.

FIGS. 8A-8D show a variety of manners in which a backing panel 804 may be coupled to (e.g. hung on) a surface (e.g., wall). For example, as shown in FIGS. 8A and 8B, the backing panel 804 may include one or more coupling elements 876 for coupling the backing panel 804 to a surface. In some embodiments, the one or more coupling elements 876 may be disposed on the backing panel 804 proximate to a folding line 828 of a hinge portion of the backing panel 804. In one or more embodiments, the coupling elements 876 may include one or more of pieces of hook and loop material or similar repositionable mechanical and/or adhesive pieces, magnets, magnet strips, removable adhesives, and Nano or biomechanical repositionable attachment elements utilizing draping adhesion and/or van der Waals' forces (e.g., GECKSKIN).

Furthermore, as shown in FIGS. 8C and 8D, in some embodiments, the backing panel 804 may be coupled to (e.g., hung on) a surface via mechanical fasteners 878, 881. For example, the backing panel 804 may be coupled to a surface with one or more of nails, hooks, screws, T-pins 881 (FIG. 8C), tacks, push pins, etc. For instance, as illustrated in FIG. 8C, in some embodiments, the backing panel 804 may be coupled to a surface with T-pins 881, and the T-pins may include pins having relatively smooth T-bar heads and typical nail shafts. Furthermore, the mechanical fasteners 878 may extend through one or more of a plurality of fastener apertures (FIG. 2A), a plurality of relief apertures (FIG. 2A), and a centered aperture (FIG. 2A). Moreover, as noted above in regard to FIG. 2A, each of the plurality of fastener apertures (FIG. 2A) and the plurality of relief apertures (FIG. 2A) may have a first aperture and a second corresponding aperture, and the mechanical fasteners 878 may extend through the second corresponding apertures while heads of the mechanical fastener 878 extend through (e.g., rest within) the first apertures. Specifically, when a hinge portion of the backing panel 804 is in a folded position, a head of a given mechanical fastener 878 may be disposed within the first aperture allowing an inner surface of the hinge portion to be at least substantially flat against the inner surface of a body portion of the backing panel 804.

Figure 9A:
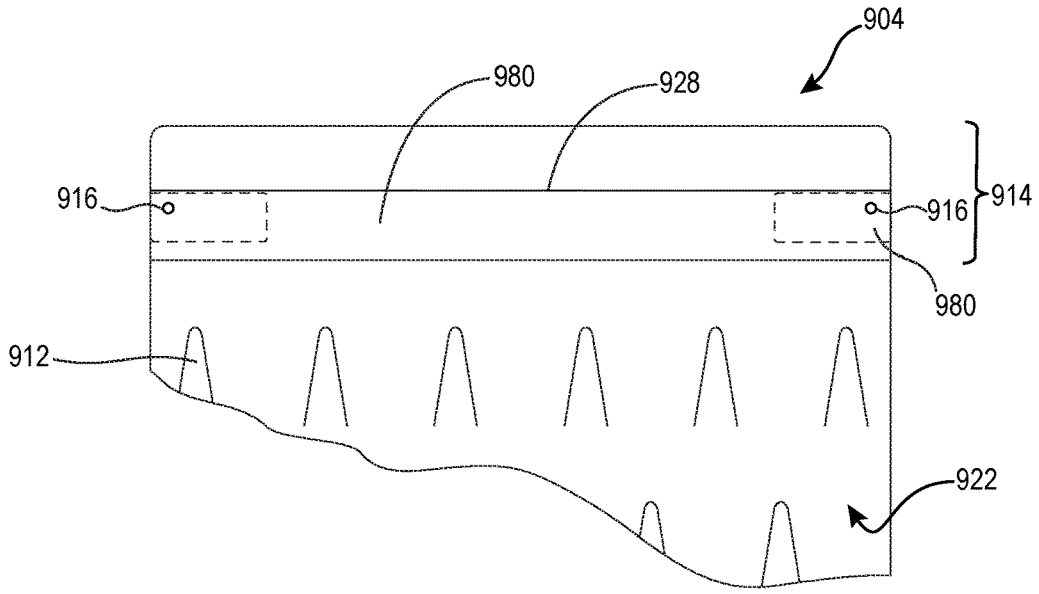
FIG. 9A shows a partial front side view of a backing panel of an image frame assembly having supporting tabs according to one or more embodiments of the present disclosure.
Figure 9B:
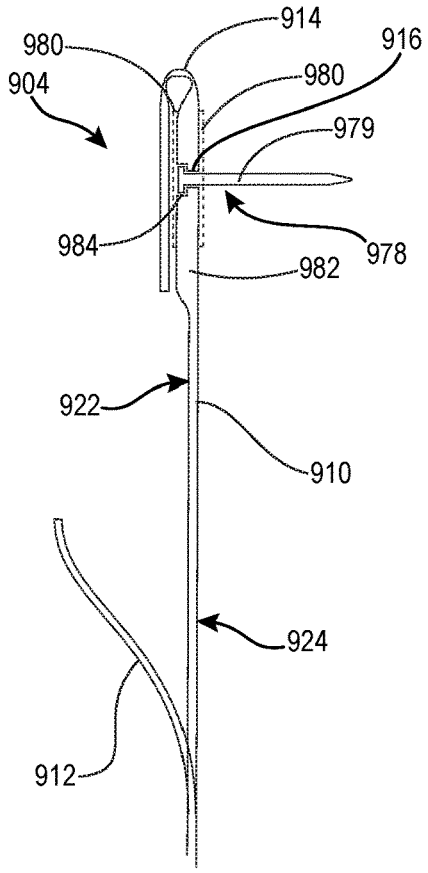
FIG. 9B shows a partial side cross-sectional view of a backing panel of an image frame assembly having a supporting tab according to one or more embodiments of the present disclosure.

Some embodiments of the present disclosure provide for supporting tabs (e.g., reinforcement tabs) for reducing a likelihood that the mechanical fasteners will tear through a backing panel of an image frame assembly. For example, FIG. 9A illustrates a partial front side view of a backing panel 904 having one or more supporting tabs 980 attached to one or more of the inner surface 922 and outer surface 924 of the backing panel 904 and proximate a plurality of fastener apertures 916. FIG. 9B shows a partial side cross-sectional view of the backing panel 904 of FIG. 9A. Referring to FIGS. 9A and 9B together, for example, the supporting tabs 980 may be aligned with the plurality of fastener apertures 916 such that, when a mechanical fastener 978 extends through a given fastener aperture 916, a respective supporting tab 980 can at least partially support the mechanical fastener 978 (e.g., support a head of nail and/or screw/or T pin).

In particular, the one or more supporting tabs 980 may allow a shaft portion 979 of a mechanical fastener 978 to extend through the given aperture while preventing a head portion of the mechanical fastener 978 from tearing through the given aperture. In some embodiments, the one or more supporting tabs 980 may include a relatively rigid material (e.g., more rigid than the backing panel 904), such as, for example, a metal material or a hard plastic (e.g., polycarbonate, polyethylene, etc.).

Furthermore, in some embodiments, the backing panel 904 may include a thicker segment 982 proximate an upper portion of a body portion 910 of the backing panel 904 through which the plurality of fastener apertures 916, the plurality of relief apertures (FIG. 2A), and/or the centered aperture (FIG. 2A) may extend. Specifically, the thicker segment 982 may have an increased thickness relative to a remainder of the backing panel 904. Furthermore, in some embodiments, for a given aperture (a fastener aperture 916, a relief aperture (FIG. 2A), and/or a centered aperture (FIG. 2A)), the thicker segment 982 may define a respective countersink hole 984. In such embodiments, the countersink hole 984 may allow the mechanical fastener 978 to be at least partially sunk within the countersink hole 984 to reduce a profile of the mechanical fastener 978 and to reduce any interference the mechanical fastener 978 may cause with the hinge portion 914 of the backing panel 904. Furthermore, in such embodiments, a supporting tab 980 may be disposed against an outer surface 924 of the backing panel 904.

Figure 10:
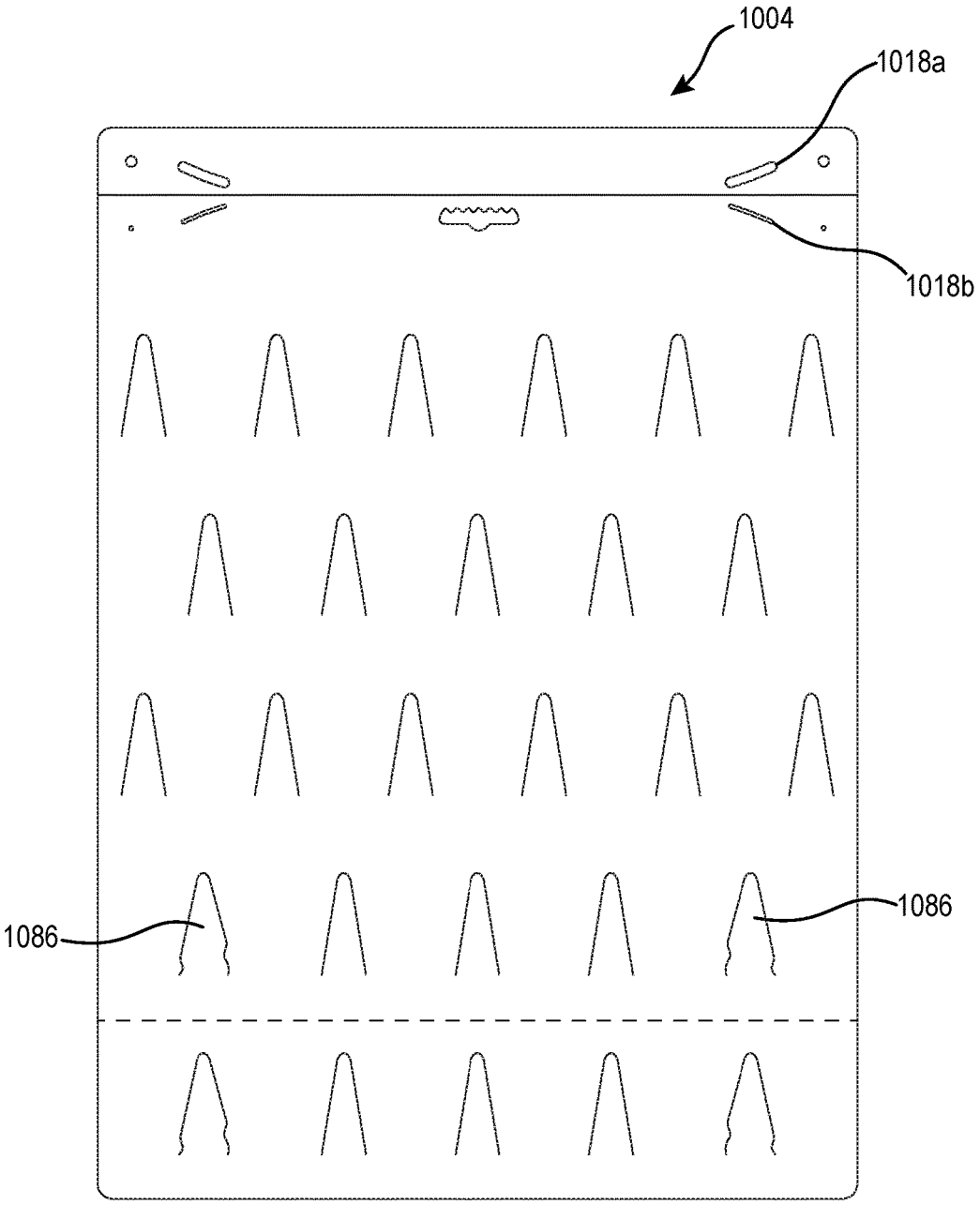
FIG. 10 shows a front side view of a backing panel of an image frame having one or more notched biased members according to one or more embodiments of the present disclosure.

Some embodiments of the present disclosure provide for connecting separate backing panels together in order to accommodate relatively large and/or uniquely shaped frame portions. For example, FIG. 10 illustrates a front side view of a backing panel 1004 according to another embodiment of the present disclosure. As show in FIG. 10, the backing panel 1004 may include one or more notched biased members 1086. Furthermore, the one or more notched biased members 1086 may be vertically aligned with the plurality of relief apertures 1018*a*, 1018*b* of the backing panel 1004. Moreover, the one or more notched biased members 1086 may be shaped (e.g., have a width and length) to fit within (e.g., extend through) the plurality of relief apertures 1018*a*, 1018*b* of a separate backing panel. In some embodiments, the one or more notched biased members 1086 may be oriented within a lower portion of the backing panel 1004. In additional embodiments, each biased member of the backing panel 1004 may include a notched biased member 1086.

Figure 11:
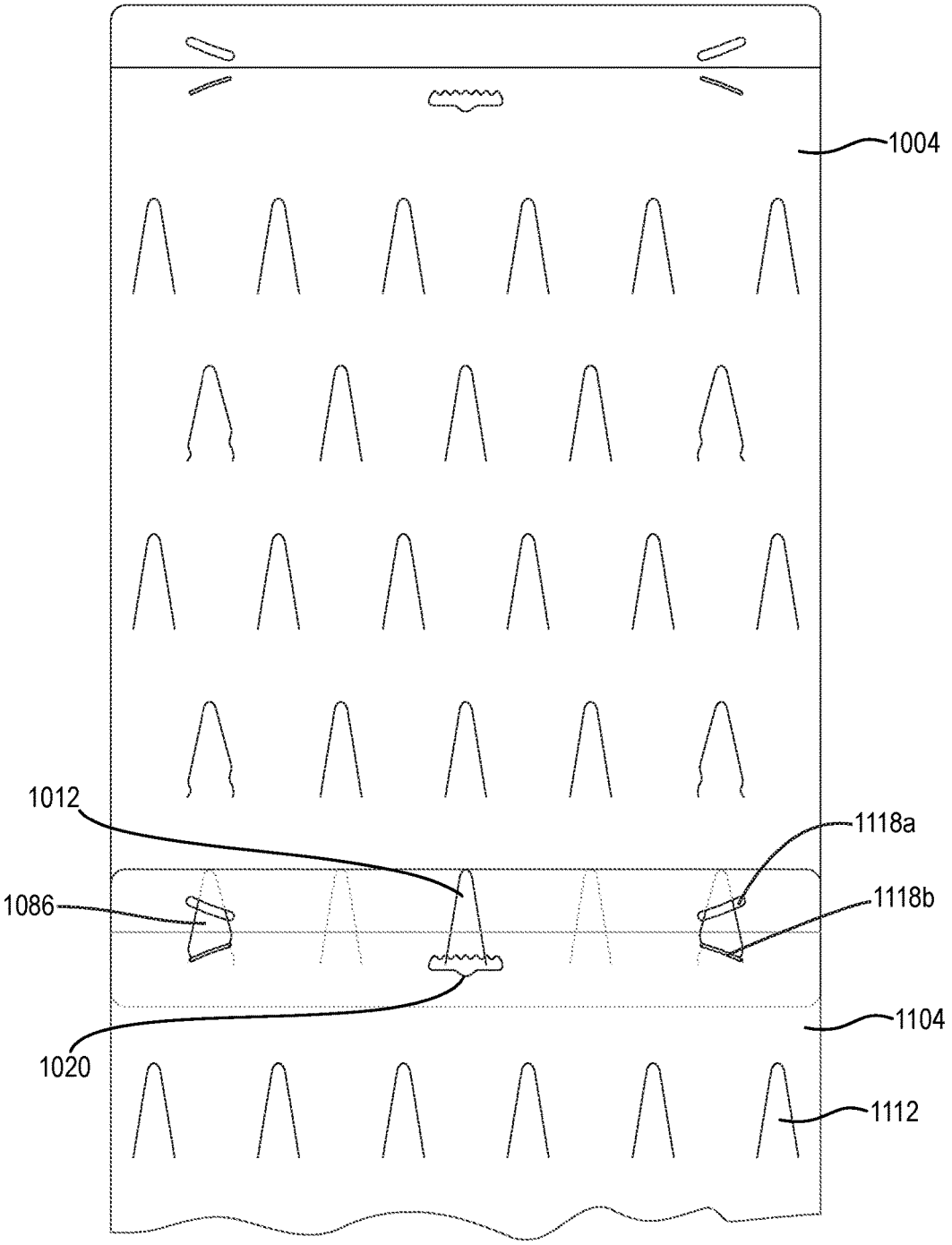
FIG. 11 shows a front side view of a backing panel coupled to a separate backing panel via notched biased members according to one or more embodiments of the present disclosure.

For instance, as illustrated in FIG. 11 a separate backing panel 1104 may be coupled to the backing panel 1004 by inserting the notched biased members 1086 of the backing panel 1004 through the plurality of relief apertures 1118*a*, 1118*b* of the separate backing panel 1104. Furthermore, a biased member 1012 of the backing panel 1004 may be inserted into a centered aperture 1020 of the separate backing panel 1104 for further support. Moreover, due to notches of the notched biased members 1086, the notches may lock (e.g., snap, click, etc.) the separate backing panel 1104 into place by holding the biased members 1086 within the plurality of relief apertures 1118*a*, 1118*b* until a threshold force is applied, at which point the plurality of relief apertures 1118*a*, 1118*b* are released from the notches. As noted above, by coupling backing panels together, the backing panels can accommodate frame portions that are larger than an individual backing panel and/or uniquely shaped frame portions.

Figure 12:
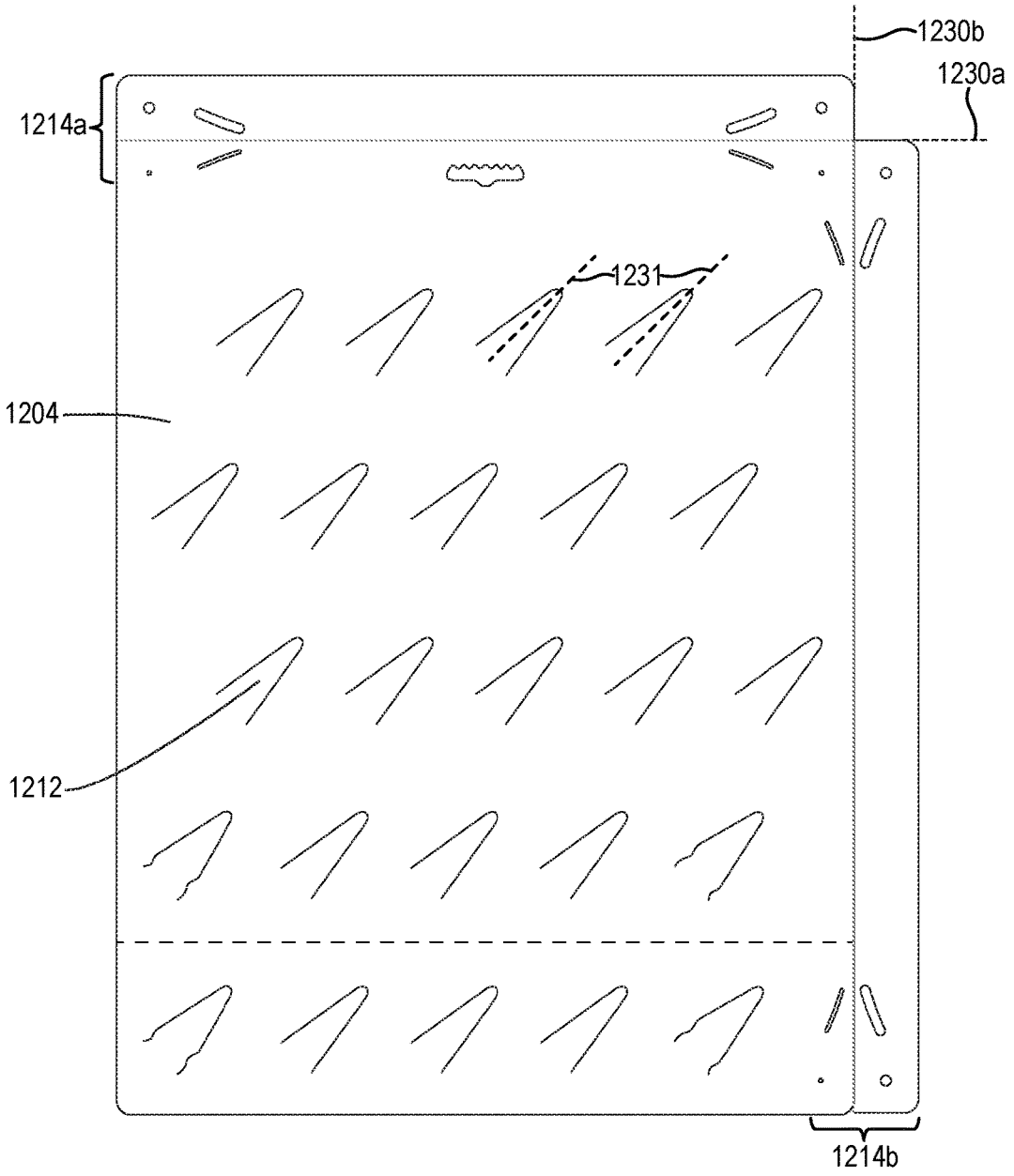
FIG. 12 shows a front side view of a backing panel having multiple hinge portions according to one or more embodiments of the present disclosure.

Furthermore, some embodiments of the present disclosure provide for bidirectional backing panel. For example, FIG. 12 shows a backing panel 1204 have a first hinge portion 1214*a* extending along a longitudinal end of the backing panel 1204 and a second hinge portion 1214*b* extending along a lateral end of the backing panel 1204. Additionally, longitudinal axes 1231 of the biased members 1212 of the backing panel 1204 may extend in a diagonal direction relative to axes of rotations 1230*a*, 1230*b* defined by the first and second hinge portions 1214*a*, 1214*b* (e.g., in a direction defining an acute angle with both the axes of rotations 1230*a*, 1230*b* defined by the first and second hinge portions 1214*a*, 1214*b*). In alternative embodiments, the longitudinal axes 1231 of the biased members 1212 may extend in different directions. For example, a first biased member of the backing panel 1204 may extend in a first direction, and a second biased member of the backing panel 1204 may extend in a second different direction. As a result, the backing panel 1204 can equally accommodate frame portions (e.g., frame portion 102) hung in either a portrait orientation or a landscape orientation.

Figure 13A:
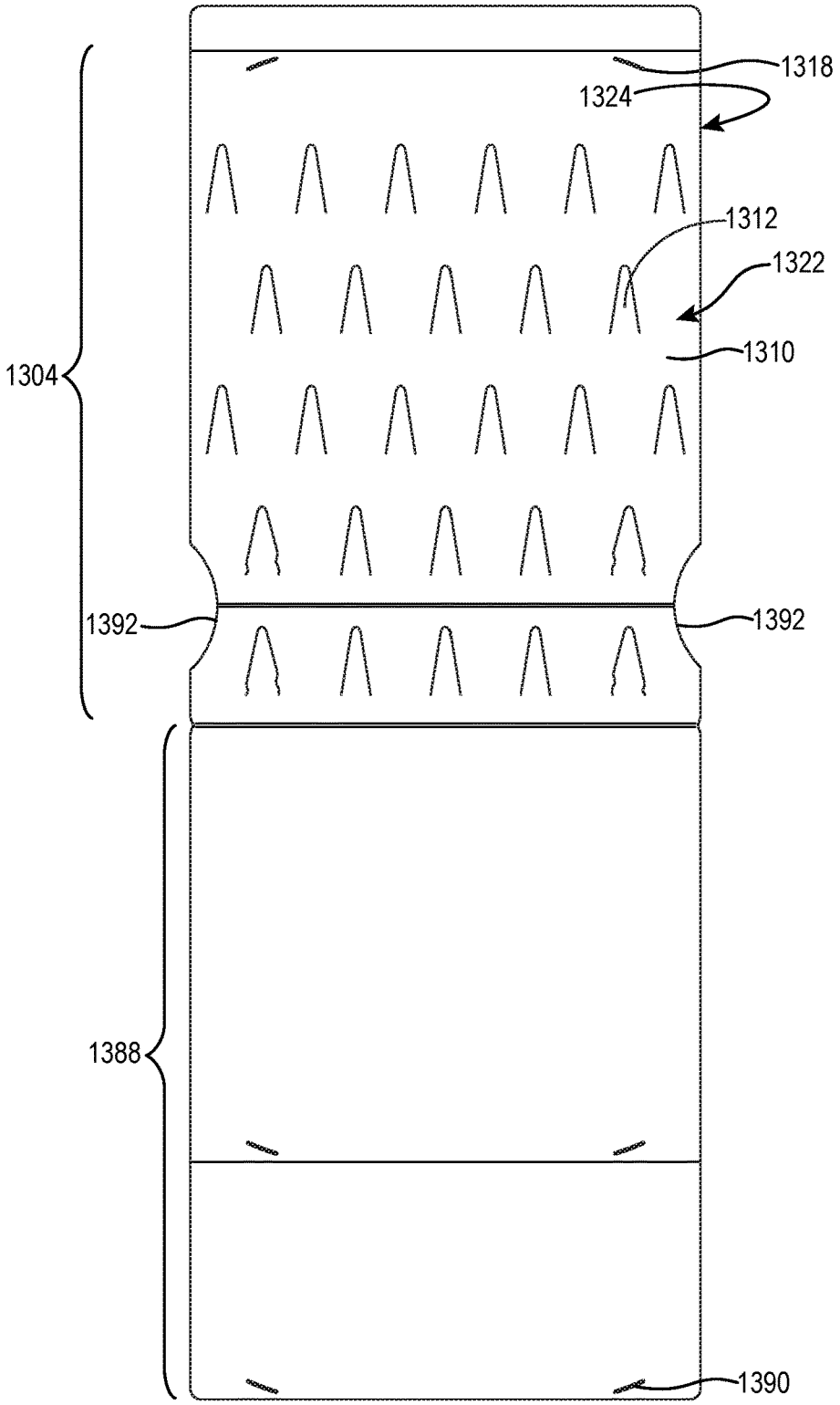
FIGS. 13A-13E shows various views of various embodiments of backing panels having additional folding panels for forming storage folders according to one or more embodiments of the present disclosure.
Figure 13B:
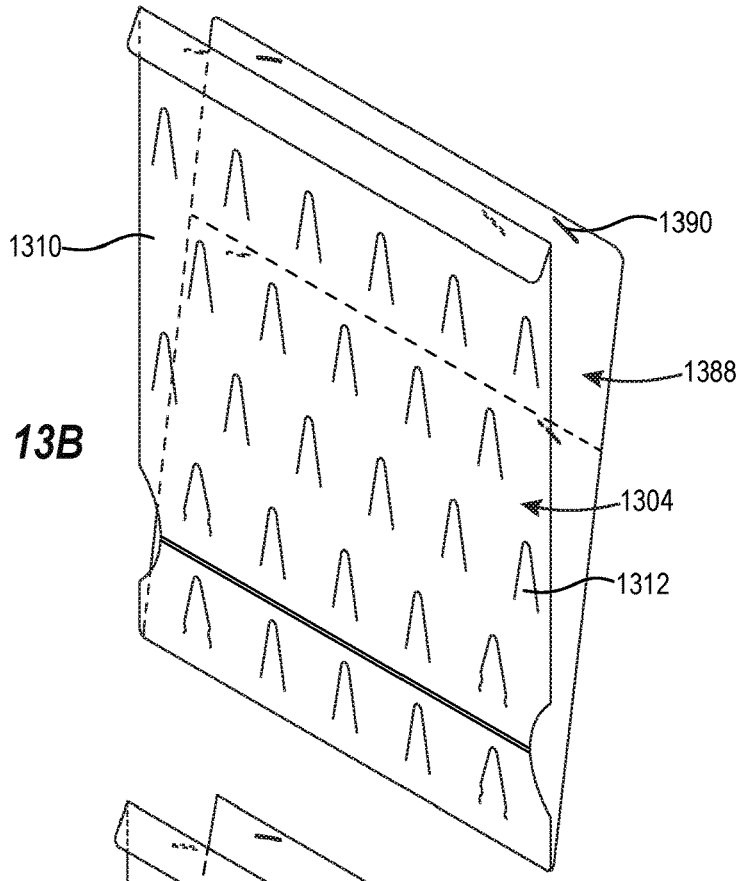
Figure 13C:
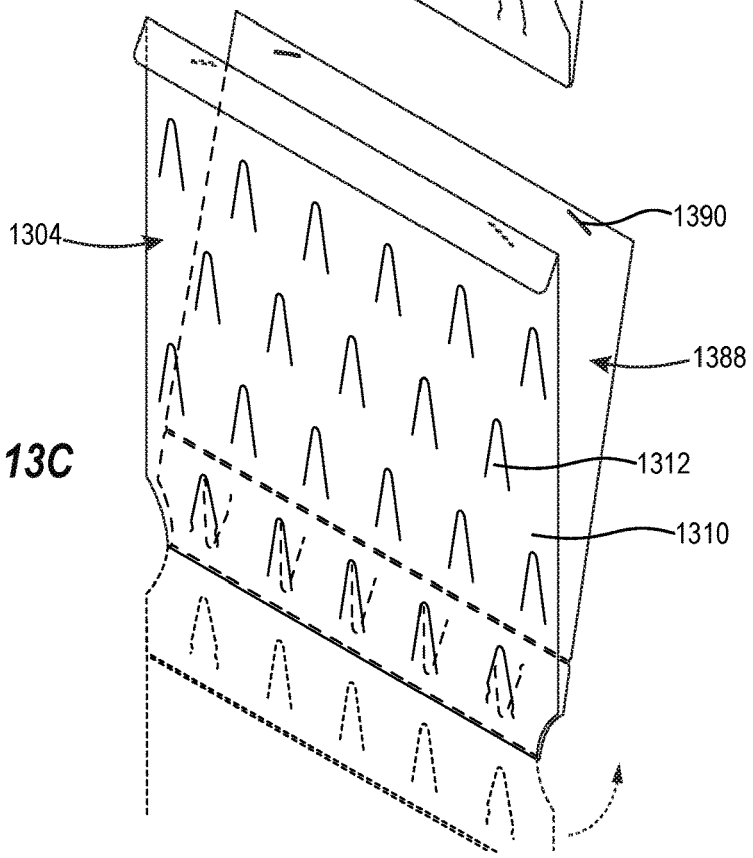

Moreover, some embodiments of the present disclosure provide for a backing panel that forms a storage folder for storing images therein. In some embodiments, as shown in FIGS. 13A-13C, a backing panel 1304 may have an additional folding panel 1388 attached to a bottom edge of a body portion 1310 of the backing panel 1304. Furthermore, the additional folding panel 1388 can be foldable along the bottom edge of the body portion 1310 and relative to the to the body portion 1310. Moreover, when the additional folding panel 1388 of the backing panel is folded relative to the body portion 1310 of the backing panel 1304, an outer surface 1324 of the body portion 1310 of the backing panel 1304 may face the additional folding panel 1388. Put another way, the additional folding panel 1388 may be foldable toward a back of the body portion 1310 of the backing panel 1304.

Figure 13D:
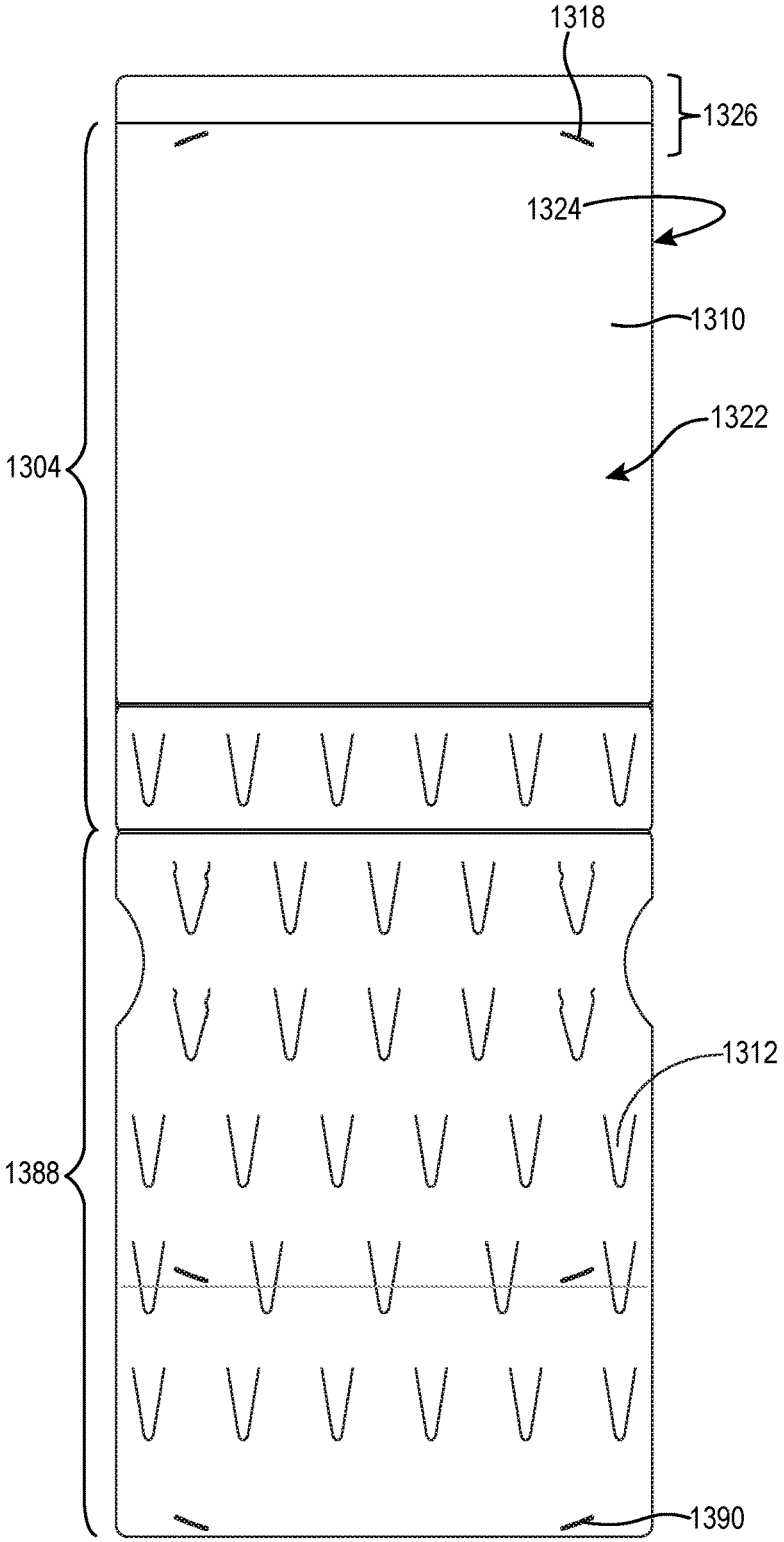
Figure 13E:
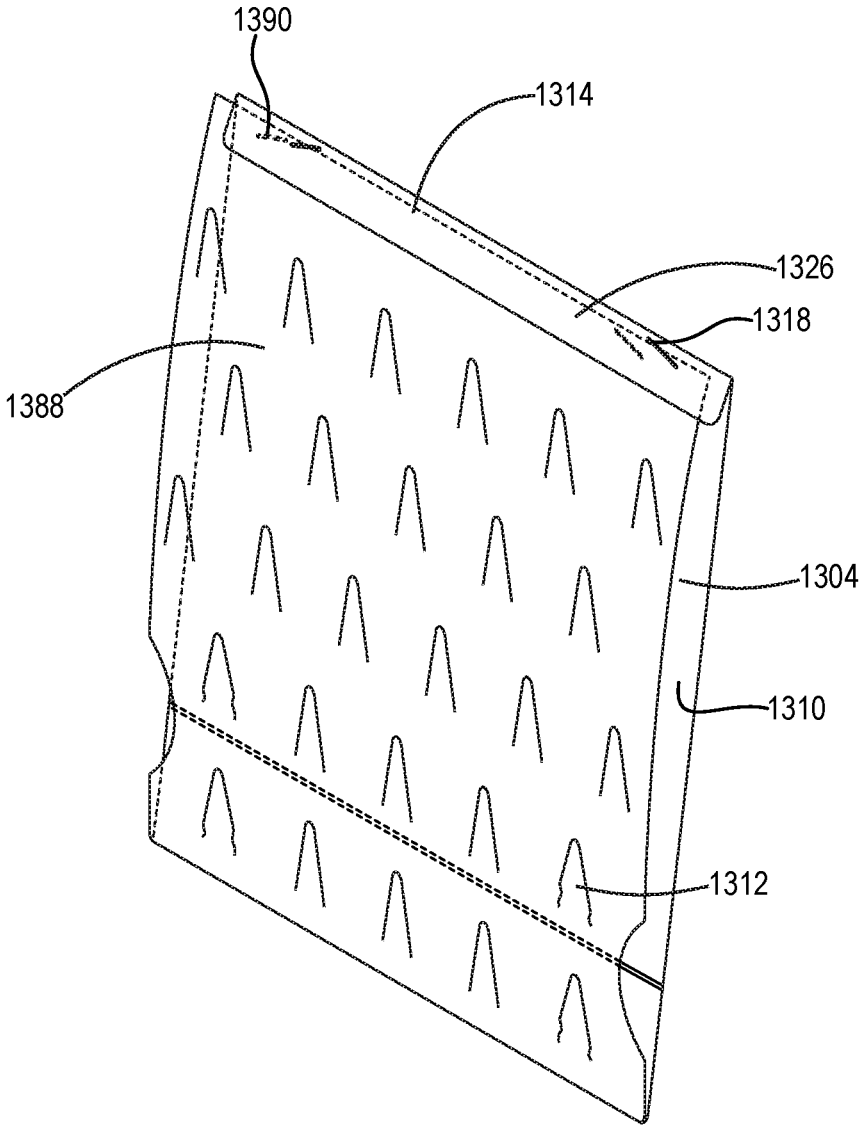

In alternative embodiments, as shown in FIGS. 13D and 13E, the backing panel 1304 may also include a plurality of biased members 1312. Furthermore, the additional folding panel 1388 may be foldable along the bottom edge of the body portion 1310 and relative to the to the body portion 1310 toward a front of the body portion 1310. For example, when the additional folding panel 1388 of the backing panel is folded relative to the body portion 1310 of the backing panel 1304, an inner surface 1322 of the body portion 1310 of the backing panel 1304 may face the additional folding panel 1388.

Moreover, in such embodiments, when folded as illustrated in FIG. 13D, the additional folding panel 1388 may be inserted at least partially between the upper segment 1326 of the hinge portion 1314 of the backing panel 1304 and the body portion 310 of the backing panel 1304. For example, the additional folding panel 1388 may be "tucked" between the upper segment 1326 of the hinge portion 1314 of the backing panel 1304 and the body portion 1310 of the backing panel 1304. Additionally, in such embodiments, the additional folding panel 1388 may include an additional plurality of relief apertures 1390 that correlate to the plurality of relief apertures 1318 of the backing panel 104 and align with the plurality of relief apertures 1318 when the additional folding panel 1388 is folded relative to the body portion 1310 of the backing panel 1304. Furthermore, the additional plurality of relief apertures 1390 may behave in the same manner as the plurality of relief apertures described above in regard to FIG. 2A.

Moreover, referring again to FIG. 13A, in one or more embodiments, the backing panel 1304 may include one or more cutouts 1392 that may allow images stored within the backing panel 1304 (e.g., storage folder) to be more accessible. For example, the one or more cutouts 1392 may extend inward from lateral edges of the body portion 1310 of the backing panel 1304. Accordingly, a user can reach through the one or more cutouts 1392 to access images within the backing panel 1304.

Figure 14:
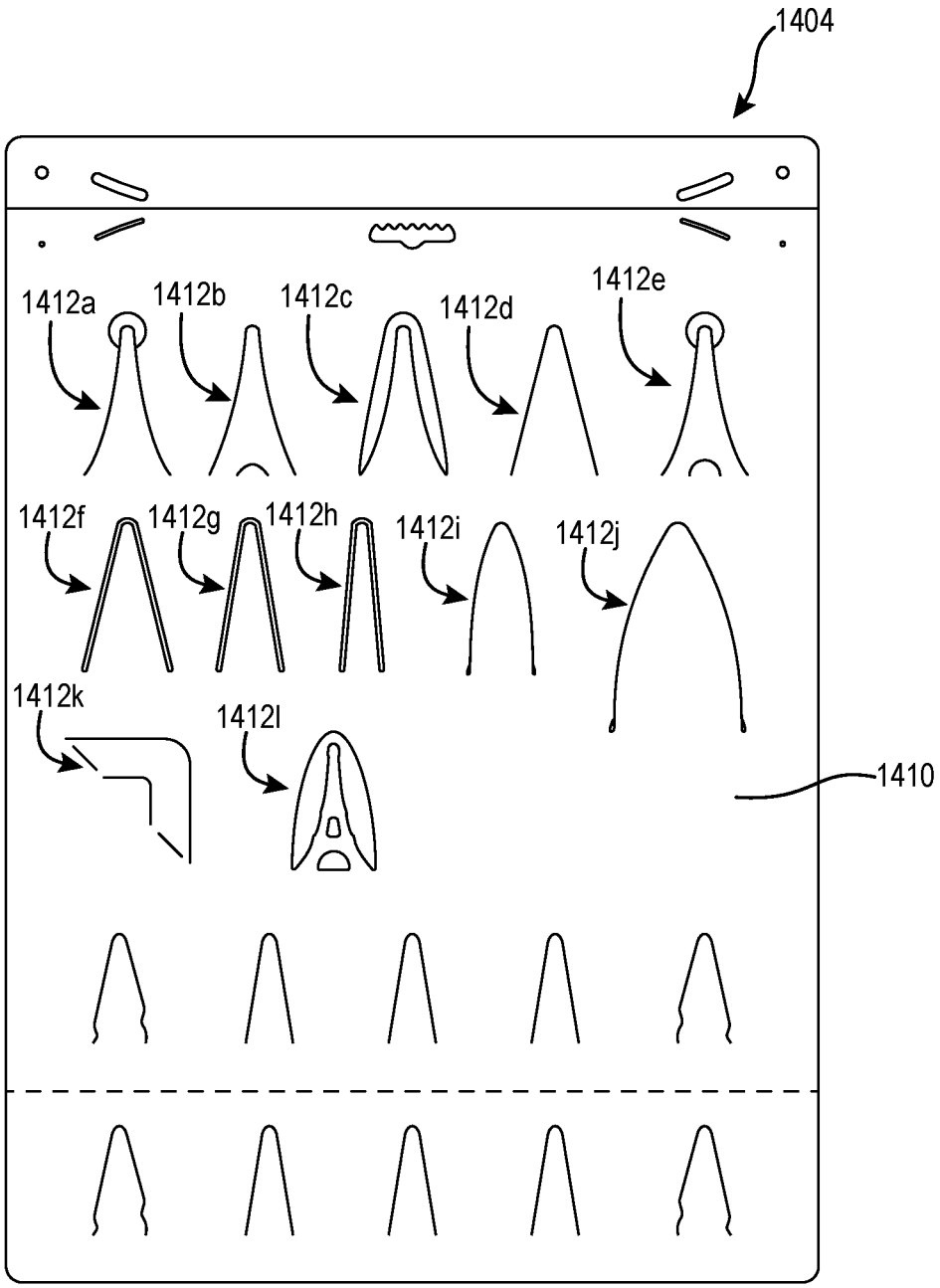
FIG. 14 shows a front side view of a backing panel having various embodiments of biased members according to one or more embodiments of the present disclosure.

FIG. 14 shows a plurality of different embodiments of biased members of the plurality of biased members. For example, in some embodiments, the plurality of biased members may include a biased member 1412*a* having a curved triangle shape. Furthermore, a tip of the biased member 1412*a* may be separated from the body portion 1410 of the backing panel 1404 by a cutout (e.g., circle cutout).

Additionally, the plurality of biased members may include a biased member 1412*b* having curved triangle shape and an additional semi-circle slit near a base of the biased member 1412*b*. Moreover, the plurality of biased members may include a biased member 1412*c* having a curved triangle shape and being separated from the body portion 1410 of the backing panel 1404 by a cutout. Likewise, the plurality of biased members may include a biased member 1412*d* having a relatively larger rounded triangle shape. Also, the plurality of biased members may include a biased member 1412*e*, which is a combination of biased members 1412*a* and 1412*b*.

Furthermore, the plurality of biased members may include biased members 1412*f*, 1412*g*, 1412*h*, which include rounded triangular shaped biased members of varying widths and being separated from the body portion 1410 of the backing panel 1404 by a slit cutout. Moreover, the plurality of biased members may include biased members 1412*i*, 1412*j*, which include swollen round triangular shapes of varying size. Additionally, the plurality of biased members may include a biased member 1412*k* including a corner tab. In yet further embodiments, the plurality of biased members 1412 (e.g., biased member 14121) may have any shape such as shapes of buildings, sunbursts, flowers, or any other geometric shape.

Figure 15:
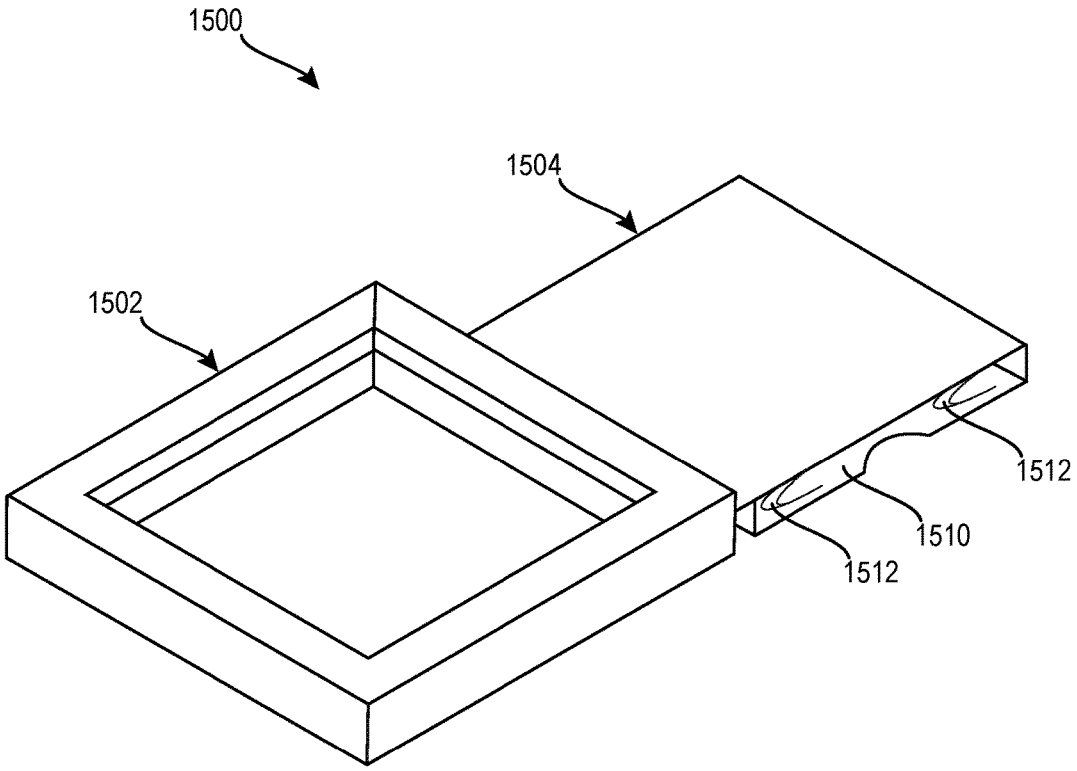
FIG. 15 shows a perspective view of a frame assembly having a frame portion and backing panel having a plurality of biased members according to another embodiment of the present disclosure.

FIG. 15 illustrates a perspective view of a frame assembly 1500 having a frame portion 1502 and backing panel 1504 having a plurality of biased members 1512 according to another embodiment of the present disclosure. As shown, the frame portion 1502 and backing portion 1504 may include a single uniform body (e.g., an injection molded uni-body) and may be attached to each other along a folding line. Furthermore, the backing portion 1504 may at least partially fit within the frame portion 1502.

Additionally, as illustrated, the frame portion 1502 may define a storage box (e.g., a rectangular cuboid storage box) for storing, e.g., images. In one or more embodiments, the frame portion 1502 may define the storage box having access openings on either vertical side of the storage box for inserting and/or removing images from the storage box. In other words, the storage box may include a rectangular sleeve. Moreover, because the backing panel 1504 at least partially fits within the frame portion, the vertical sides of the storage box may be at least partially covered by the frame portion 1502 (e.g., side members of the frame portion 1502) when the frame assembly 1500 is closed thereby forming an enclosure for images.

Moreover, because the backing panel 1504 includes a rectangular sleeve, a portion of the backing panel 1504 pressing up against an image, when the frame assembly 1500 is closed (e.g., the body portion 1510 and biased member 1512), is offset from a surface (e.g., a wall) to which the backing panel 1504 is attached. As a result, the backing panel 1504, in some embodiments, may not include the biased members 1512. Rather, the body portion 1510 of the backing panel 1504 may press an image up against a transparent panel or rabbet of the frame portion 1502 to hold the image in place.

Figure 16:
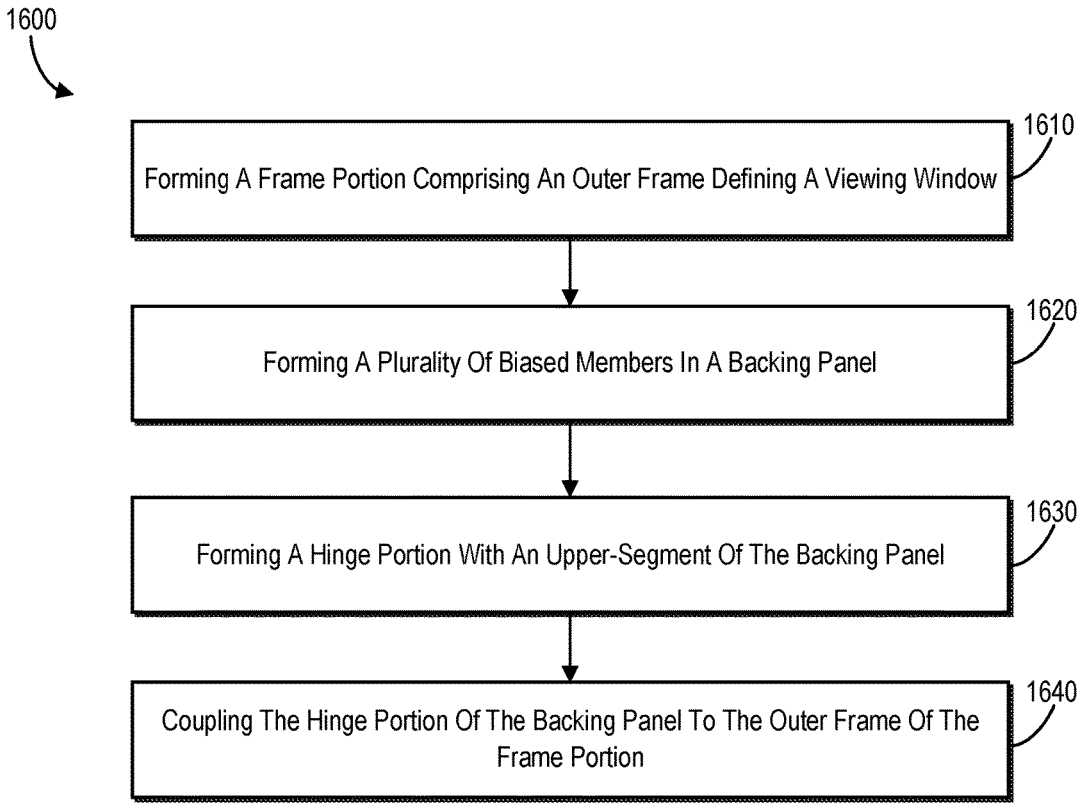
FIG. 16 shows a method flow diagram of making an image frame assembly according to one or more embodiments of the present disclosure.

Some embodiments of the present disclosure include a method of making an image frame assembly (e.g., image frame assembly 100 of FIG. 1). For example, FIG. 16 illustrates a flow diagram showing a method 1600 of making an image frame assembly. In one or more embodiments, the method 1600 can include an act 1610 of forming a frame portion. In particular, act 1610 can include forming a frame portion of the image frame assembly comprising an outer frame defining a viewing window.

Additionally, the method 1600 can include an act 1620 of forming a plurality of biased member in a backing panel. In some embodiments, forming the plurality of biased members in a backing panel can include stencil cutting the plurality of biased members in a backing panel. Furthermore, forming the plurality of biased members in a backing panel may include forming a plurality of partial cutouts in the backing panel and at least partially raising (e.g., bending) each partial cutout of the plurality of partial cutouts relative to the backing panel and in a direction toward to the frame portion of the image frame assembly. Moreover, act 1620 may include forming the plurality of biased members in the backing panel to include any of the biased members described above in regard to FIGS. 2A-2B, FIGS. 7A-7E, FIG. 12, and FIG. 14.

Furthermore, the method 1600 can include an act 1630 of forming a hinge portion. For instance, act 1630 can include forming a hinge portion with an upper segment of the backing panel. In one or more embodiments, forming the hinge portion can include folding the upper segment of the backing portion back on the backing portion along a folding line. Moreover, act 1630 can include forming the hinge portion to include any of the hinge portions described above in regard to FIGS. 2A-5B.

Moreover, the method 1600 can include an act 1640 of coupling the hinge portion to the frame portion. For example, act 1640 can include coupling the hinge portion of the backing panel to the outer frame of the frame portion. In some embodiments, act 1640 includes coupling the hinge portion of the backing panel to the outer frame such that the outer frame of the frame portions is rotatable relative to the backing panel about an axis of rotation collinear with the folding line. In additional embodiments, act 1640 includes coupling the hinge portion of the backing panel to the outer frame with an adhesive. Furthermore, coupling the hinge portion of the backing panel to the outer frame may include coupling the hinge portion of the backing panel to the outer frame via any of the securing elements and/or detachable securing elements described above in regard to FIG. 6.

The present disclosure may be embodied in other specific forms without departing from its spirit or essential characteristics. Thus, the described embodiments are to be considered in all respects only as illustrative and not restrictive. The scope of the disclosure is, therefore, indicated by the appended claims rather than by the foregoing description. All changes that come within the meaning and range of equivalency of the claims are to be embraced within their scope.

What is claimed is:

1. An image frame assembly comprising:

a frame portion defining a viewing window; and a backing panel attached to a back of the frame portion, the backing panel being a single body of material and comprising:

a hinge portion that rotatably couples the backing panel to the frame portion to allow the frame portion to rotate relative to the backing panel about an axis extending parallel to and proximate to an upper edge of the backing panel, wherein the hinge portion comprises an upper segment of the backing panel folded along a folding line toward an inner surface of the backing panel that faces the frame portion;

wall attachment means located on the hinge portion of the backing panel, wherein when the wall attachment means attaches the image frame assembly to a wall the image frame assembly comprises an open position and a closed position, wherein:

when in the open position, the backing panel is positioned adjacent to, and parallel with, the wall and a lower member of the frame portion is rotated about the axis to a position away from the backing panel to provide an access to an interior of the image frame; and when in the closed position, the backing panel is positioned adjacent to, and parallel with, the wall and the lower member of the frame portion is rotated about the axis to a position proximate the backing panel so that the frame portion is parallel with the backing panel;

a body portion extending from the hinge portion and having an area that at least partially fits within the viewing window defined by the frame portion when the image frame assembly is in the closed position; and a plurality of biased members extending from the body portion and toward the viewing window when the image frame assembly is in the closed position.

2. The image frame assembly of claim 1, wherein when the image frame assembly is in the closed position, the upper segment of the hinge portion of the backing panel is positioned between the body portion of the backing panel and the frame portion.

3. The image frame assembly of claim 1, wherein the folding line of the hinge portion comprises a narrow portion with a thickness that is less than a thickness of the upper segment of the hinge portion and less than a thickness of the body portion of the backing panel.

4. The image frame assembly of claim 1, wherein the upper segment of the hinge portion of the backing panel is coupled to the frame portion with an adhesive.

5. The image frame assembly of claim 1, further comprising a transparent panel disposed within the viewing window of the frame portion.

6. The image frame assembly of claim 1, wherein the frame portion comprises a plurality of frame members and wherein the backing panel is coupled to an upper frame member of the plurality of frame members.

7. The image frame assembly of claim 1, wherein each biased member of the plurality of biased members comprises a partial cutout of the backing panel, the partial cutout being at least partially raised relative to the inner surface of the backing panel facing the frame portion.

8. The image frame assembly of claim 1, wherein a longitudinal axis of each biased member of the plurality of biased members extends in a direction at least substantially perpendicular to the axis about which the frame portion rotates.

9. The image frame assembly of claim 1, wherein each biased member of the plurality of biasing members comprises a rounded triangular shape having a base of the rounded triangular shape attached to the body portion of the backing panel.

10. An image frame assembly comprising:

a frame portion defining a viewing window;

a transparent panel disposed within the viewing window of the frame portion; and a backing panel attached to the frame portion and having an area that at least partially fits within the viewing window, the backing panel being a single body of material and comprising:

a hinge portion that rotatably couples the backing panel to the frame portion to allow the frame portion and the transparent panel to rotate relative to the backing panel, wherein the hinge portion comprises an upper segment of the backing panel folded along a folding line toward an inner surface of the backing panel that faces the frame portion; and wall attachment means located on the hinge portion of the backing panel, wherein when the wall attachment means attaches the image frame assembly to a wall the image frame assembly comprises an open position and a closed position, wherein:

when in the open position, the backing panel is positioned adjacent to, and parallel with, the wall and a lower member of the frame portion is rotated to a position away from the backing panel to provide an access to an interior of the image frame; and when in the closed position, the backing panel is positioned adjacent to, and parallel with, the wall and the lower member of the frame portion is rotated to a position proximate the backing panel so that the frame portion is parallel with the backing panel.

11. The image frame assembly of claim 10, wherein the hinge portion is positioned to allow the frame portion and the transparent panel to rotate about an at least substantially horizontal axis extending parallel and proximate to an upper edge of the backing panel.

12. The image frame assembly of claim 10, wherein the wall attaching means comprises at least one aperture for attaching the image frame assembly to the wall.

13. The image frame assembly of claim 12, wherein the wall attaching means further comprises a fastener extending through the at least one aperture of the backing panel and attaching the image frame assembly to the wall.

14. The image frame assembly of claim 13, wherein the access to the interior of the image frame allows for the installation and removal of an image without detaching the image frame assembly from the wall.

15. The image frame assembly of claim 10, wherein when the image frame assembly is in the closed position, the upper segment of the hinge portion of the backing panel is positioned between the body portion of the backing panel and the frame portion.

16. A method of making an image frame assembly, the method comprising:

forming a frame portion defining a viewing window;

forming a plurality of biased members in a body portion of a backing panel of the image frame assembly;

forming a hinge portion on the backing panel, wherein the hinge portion comprises an upper segment of the backing panel folded along a folding line toward an inner surface of the backing panel that faces the frame portion; and coupling the upper segment of the hinge portion of the backing panel to the frame portion while leaving the body portion of the backing panel unattached from the frame assembly to create an open position and a closed position of the image frame assembly when the image frame assembly is attached to a wall, wherein:

when in the open position, the backing panel is positioned adjacent to, and parallel with, the wall and a lower member of the frame portion is rotated to a position away from the backing panel to provide an access to an interior of the image frame; and when in the closed position, the backing panel is positioned adjacent to, and parallel with, the wall and the lower member of the frame portion is rotated to a position proximate the backing panel so that the frame portion is parallel with the backing panel.

17. The method of claim 16, further comprising forming the folding line for the hinge portion by creating a narrow portion within the backing panel having a thickness that is less than a thickness of the upper segment and less than a thickness of the body portion of the backing panel.

18. The method of claim 17, wherein coupling the upper segment of the hinge portion of the backing panel to the frame portion comprises coupling the upper segment of the hinge portion of the backing panel to the frame portion such that the frame portion is rotatable relative to the backing panel about an axis of rotation collinear with the folding line.

19. The method of claim 16, wherein forming a plurality of biased members comprises:

forming a plurality of partial cutouts in the backing panel; and at least partially raising each partial cutout of the plurality of partial cutouts relative to the backing panel and in a direction toward the frame portion of the image frame assembly.

20. The method of claim 16, wherein coupling the upper segment of the hinge portion of the backing panel to the frame portion comprises coupling the upper segment of the hinge portion of the backing panel to the frame portion with an adhesive.

* * * * *